US006637334B2

(12) United States Patent
Akiyama et al.

(10) Patent No.: US 6,637,334 B2
(45) Date of Patent: Oct. 28, 2003

(54) HEAT-SENSITIVE LITHOGRAPHIC PRINTING PLATE PRECURSOR

(75) Inventors: Keiji Akiyama, Shizuoka (JP); Hisashi Hotta, Shizuoka (JP); Kazuo Maemoto, Shizuoka (JP)

(73) Assignee: Fuji Photo Film Co., Ltd., Minami Ashigara (JP)

( * ) Notice: Subject to any disclaimer, the term of this patent is extended or adjusted under 35 U.S.C. 154(b) by 0 days.

(21) Appl. No.: 09/827,934

(22) Filed: Apr. 9, 2001

(65) Prior Publication Data

US 2002/0033108 A1 Mar. 21, 2002

(30) Foreign Application Priority Data

| | | |
|---|---|---|
| Apr. 7, 2000 | (JP) | 2000-106869 |
| Apr. 17, 2000 | (JP) | 2000-115420 |
| May 16, 2000 | (JP) | 2000-143387 |
| May 17, 2000 | (JP) | 2000-144848 |
| Aug. 31, 2000 | (JP) | 2000-263812 |
| Aug. 31, 2000 | (JP) | 2000-263813 |

(51) Int. Cl.[7] ..... B41N 1/08; B41N 3/03

(52) U.S. Cl. ..... 101/457; 101/458; 101/467; 205/127; 205/175; 205/229; 205/921

(58) Field of Search ..... 101/454, 455, 101/456, 457, 458, 459, 463.1, 465, 466, 467; 205/127, 175, 229, 921

(56) References Cited

U.S. PATENT DOCUMENTS

| | | | | | |
|---|---|---|---|---|---|
| 3,511,661 | A | | 5/1970 | Rauner et al. | |
| 3,808,000 | A | * | 4/1974 | Magnotta et al. | 101/459 |
| 3,861,917 | A | * | 1/1975 | Magnotta et al. | 101/459 |
| 5,112,743 | A | * | 5/1992 | Kamiya et al. | 430/175 |
| 5,217,601 | A | * | 6/1993 | Nakada et al. | 205/324 |
| 5,334,297 | A | * | 8/1994 | Nakada et al. | 205/173 |
| 5,486,283 | A | * | 1/1996 | Mnich | 205/175 |
| 5,674,658 | A | * | 10/1997 | Burberry et al. | 430/302 |
| 5,811,215 | A | * | 9/1998 | Van Damme et al. | 101/459 |
| 6,030,750 | A | | 2/2000 | Vermeersch et al. | |
| 6,095,048 | A | * | 8/2000 | Ellis | 101/462 |
| 6,098,544 | A | * | 8/2000 | Figov | 101/462 |
| 6,399,270 | B1 | * | 6/2002 | Mori et al. | 101/453 |

FOREIGN PATENT DOCUMENTS

| | | | |
|---|---|---|---|
| EP | 0218160 | | 4/1987 |
| EP | 0835764 | A1 | 4/1998 |
| EP | 0903224 | A2 | 3/1999 |
| EP | 0938972 | A1 | 9/1999 |
| EP | 0943451 | A1 | 9/1999 |
| FR | 1551884 | | 1/1969 |
| GB | 1412004 | * | 10/1975 |
| JP | 11-65096 | * | 3/1999 |
| JP | 11-291657 | * | 10/1999 |
| JP | 2001-277740 | | 10/2001 |

OTHER PUBLICATIONS

Computer Translation of JP 11–65096.*

* cited by examiner

*Primary Examiner*—Stephen R. Funk
(74) *Attorney, Agent, or Firm*—Burns, Doane, Swecker & Mathis, LLP

(57) ABSTRACT

A heat-sensitive lithographic printing plate precursor which comprises a substrate having thereon an anodic oxidation layer, with the printing plate precursor comprising a hydrophilic layer containing at least one kind of fine particles selected from the group consisting of heat-fusible hydrophobic thermoplastic fine particles, finely divided polymers having thermally reactive functional groups and microcapsules in which compounds having heat-reactive functional groups are encapsulated, and with the anodic oxidation layer having a surface over which micropores having an average pore size of 6 to 40 nm are uniformly distributed.

13 Claims, No Drawings

HEAT-SENSITIVE LITHOGRAPHIC PRINTING PLATE PRECURSOR

FIELD OF THE INVENTION

The present invention relates to a heat-sensitive lithographic printing plate precursor suitable for a computer-to-plate system requiring no development-processing. More specifically, the present invention is concerned with a heat-sensitive lithographic printing plate precursor on which images can be recorded by infrared ray scanning exposure based on digital signals, and besides, which can be mounted in a printing machine (i.e., a printing press) after recording images are recorded thereon and subjected to printing operations without going through a conventional liquid development process.

BACKGROUND OF THE INVENTION

A great many pieces of research have been done on the lithographic printing plate precursors suitable for computer-to-plate systems in which significant headway has recently been made. Of those plate precursors, lithographic printing plate precursors of the type which can be mounted in a printing machine without performing development after exposure and can undergo printing operations have been studied more actively with the aims of further streamlining the plate-making process and solving liquid waste disposal problems, and various methods have been proposed. One of the promising methods hitherto proposed consists in using a heat-sensitive lithographic printing plate precursor having as an image-forming layer a hydrophilic layer comprising a hydrophilic binder polymer and fine particles of hydrophobic thermoplastic polymer dispersed therein. More specifically, the method utilizes a phenomenon that, when heat is applied to the hydrophilic layer, the fine particles of hydrophobic thermoplastic polymer are fused to convert the water-receptive surface into an ink-receptive image area.

As a way of eliminating a processing step from the method of utilizing thermal fusion of fine particles of hydrophobic thermoplastic polymer, there is known the system referred to as on-press development wherein an exposed printing plate precursor is mounted on the cylinder of a printing machine and thereto a fountain solution and ink are fed while rotating the cylinder to result in removal of non-image areas from the printing plate precursor. In other words, this system is characterized in that the printing plate precursor after exposure is mounted in a printing machine as it is and the processing thereof is completed during the usual printing process.

In order that lithographic printing plate precursors acquire suitability for such on-press development, it is required for them to have not only a hydrophilic layer soluble in a fountain solution and an ink solvent but also illuminated handling capabilities so as to fit the development on a printing machine installed in a bright room.

For instance, Japanese Patent 2938397 discloses the lithographic printing plate precursor having on a water-receptive substrate a photosensitive layer (hydrophilic layer) containing fine particles of thermoplastic hydrophobic polymer in a condition that they are dispersed in a hydrophilic binder polymer. The publication cited above describes that on-press development with a fountain solution and/or ink can be achieved when the lithographic printing plate precursor is mounted on the cylinder of a printing machine after the fine particles of thermoplastic hydrophobic polymer coalesce thermally by being exposed to infrared ray laser beams to form images in the printing plate precursor.

In addition, JP-A-9-127683 (the term "JP-A" as used herein means an "unexamined published Japanese patent application") and WO99-10186 also describe that printing plates can be made by on-press development after thermal coalescence of thermoplastic fine particles.

Although such a method as to form images by thermal coalescence of fine particles can ensure excellent on-press developability, it has a problem of being inferior in press life because the adhesion between an aluminum substrate and the images formed is weak, and besides, the image strength is low.

As a solution to the problem, it is known to utilize a phosphoric acid bath anodic oxidation layer having high adhesive strength. However, this method has a drawback of causing deterioration in ink eliminability.

Further, JP-A-8-48020 discloses the method in which an ink-receptive heat-sensitive layer is provided on a porous water-receptive substrate and exposed to infrared ray laser beams, thereby thermally adhering the heat-sensitive layer to the substrate. However, the ink-receptive coating is inferior in on-press developability, and scum on the ink-receptive heat-sensitive layer causes a trouble of adhering to ink rollers or printed matters.

SUMMARY OF THE INVENTION

An object of the present invention is to provide a heat-sensitive lithographic printing plate precursor capable of overcoming the defects of prior arts. That is, the present invention aims to provide a heat-sensitive lithographic printing plate precursor which has excellent on-press developability, and can ensure a long press life, high scumming resistance and high ink eliminability in the printing process.

As a result of our intensive studies, it has been found that the aforedescribed object can be achieved by controlling the average pore diameter (i.e., the average pore size) of micropores present in an anodically treated substrate to a specified range, or by using a substrate immersed in a water solution of hydrophilic compound or coated with a water-receptive subbing layer after a pore-widening treatment. Specifically, the following are embodiments of the present invention:

1. A heat-sensitive lithographic printing plate precursor which comprises a substrate having thereon an anodic oxidation layer, the printing plate precursor comprising a hydrophilic layer containing at least one kind of fine particles selected from the group consisting of heat-fusible hydrophobic thermoplastic fine particles, finely divided polymers having heat-reactive functional groups and microcapsules in which compounds having heat-reactive functional groups are encapsulated, and with the anodic oxidation layer having a surface over which micropores having an average pore size of 6 to 40 nm are uniformly distributed.
2. The heat-sensitive lithographic printing plate precursor according to Embodiment 1, wherein the average pore size of micropores is controlled to 6 to 40 nm by subjecting the substrate having an anodic oxidation layer to a pore-widening treatment by immersion in sulfuric acid, phosphoric acid, a mixture of these acids or an aqueous alkali solution adjusted to pH 11–13, or to the pore-widening treatment and then to a pore-sealing treatment.
3. The heat-sensitive lithographic printing plate precursor according to Embodiment 1, wherein the average pore size of micropores is controlled to 6 to 40 nm by subjecting the substrate having an anodic oxidation layer to a pore-widening treatment by immersion in an aqueous sulfuric acid solution and then to a pore-sealing treatment.

4. The heat-sensitive lithographic printing plate precursor according to Embodiment 2 or 3, wherein the pore-sealing treatment is a treatment by steam.

5. A heat-sensitive lithographic printing plate precursor which comprises a substrate having thereon an anodic oxidation layer, the printing plate precursor comprising a hydrophilic layer containing at least one kind of fine particles selected from the group consisting of heat-fusible hydrophobic thermoplastic fine particles, finely divided polymers having heat-reactive functional groups and microcapsules in which compounds having heat-reactive functional groups are encapsulated, and the anodic oxidation layer having a surface over which micropores are subjected to a pore-widening treatment and then to an immersion treatment in an aqueous solution containing a hydrophilic compound.

6. A heat-sensitive lithographic printing plate precursor which comprises a substrate having thereon an anodic oxidation layer, with the printing plate precursor comprising a hydrophilic layer containing at least one kind of fine particles selected from the group consisting of heat-fusible hydrophobic thermoplastic fine particles, finely divided polymers having heat-reactive functional groups and microcapsules in which compounds having heat-reactive functional groups are encapsulated, and the anodic oxidation layer having a surface over which micropores subjected to a pore-widening treatment are uniformly distributed and further having on the surface a subbing layer comprising a water-soluble resin containing carboxyl or carboxylato groups and a water-soluble salt containing at least one metal selected from the group consisting of zinc, calcium, magnesium, barium, strontium, cobalt, manganese and nickel.

7. The heat-sensitive lithographic printing plate precursor according to Embodiment 5 or 6, wherein the pore-widening treatment is a treatment carried out by immersing the substrate having an anodic oxidation layer in an aqueous solution of sulfuric acid or an aqueous alkali solution adjusted to pH 11–13.

8. The heat-sensitive lithographic printing plate precursor according to Embodiment 5, wherein the hydrophilic compound is at least one compound selected from the group consisting of alkali metal silicates, zirconium potassium fluoride, mixtures of alkali metal phosphates and alkali metal fluorides, polyvinylphosphonic acid, sodium lignin sulfonate and saponin.

9. The heat-sensitive lithographic printing plate precursor according to Embodiment 6, wherein the water-soluble resin containing carboxyl or carboxylato groups is at least one resin selected from the group consisting of carboxymethyl cellulose, polyacrylic acid and acrylamide-methacrylic acid copolymer.

10. The heat-sensitive lithographic printing plate precursor according to Embodiment 6, wherein the water-soluble salt of metal is an acetate of at least one metal selected from the group consisting of magnesium, nickel, manganese, calcium and nickel.

11. The heat-sensitive lithographic printing plate precursor according to any of Embodiments 1 to 10, wherein the hydrophilic layer has thereon a water-soluble overcoat layer.

12. The heat-sensitive lithographic printing plate precursor according to Embodiment 11, wherein the water-soluble overcoat layer contains a light-to-heat converting agent.

13. A method of making a printing plate from a heat-sensitive lithographic printing plate precursor and printing from the printing plate made, comprising steps of image exposing a heat-sensitive lithographic printing plate precursor as described in any of Embodiments 1 to 12, using laser beams, mounting the printing plate precursor image wise exposed in a printing machine as it is without any further processing and then performing printing operations; or comprising steps of mounting in a printing machine a heat-sensitive lithographic printing plate precursor as described in any of Embodiments 1 to 12, imagewise exposing the printing plate precursor mounted in the printing machine, using laser beams and then performing printing operations without any further processing.

DETAILED DESCRIPTION OF THE INVENTION

Modes for carrying out the present invention are illustrated below in detail.

As a substrate of the lithographic printing plate precursor of the present invention, anodized aluminum sheets are suitable. The aluminum sheets (including plates) are sheets of metals containing dimensionally stable aluminum as the main component, inclusive of aluminum and aluminum alloys. Examples of such sheets include a pure aluminum sheet, sheets of aluminum alloys containing trace amounts of foreign elements, and aluminum- or aluminum alloy-laminated or deposited plastic films or paper sheets. In addition, the composite sheet made up of polyethylene terephthalate film and an aluminum sheet bound thereon as disclosed in JP-B-48-18327 (the term "JP-B" as used herein means an "examined Japanese patent publication") may be used.

The term "aluminum substrate" as used hereinafter is intended to include all the above-described substrates in which aluminum or aluminum alloys are comprised. Examples of foreign metals contained in aluminum alloys, include silicon, iron, manganese, copper, magnesium, chromium, zinc, bismuth, nickel and titanium. The content of those foreign metals in aluminum alloy is 10 weight % at the highest. Although it is preferable to use a pure aluminum sheet in the present invention, sheets of aluminum containing trace amounts of foreign elements may be employed because absolutely pure aluminum is difficult to produce due to limitations of smelting technology. In other words, aluminum sheets usable in the present invention have no particular restrictions as to their aluminum purity and impurity composition. So, any of hitherto known and widely used aluminum materials, e.g., JIS A 1050, JIS A 1100, JIS A 3103 and JIS A 3005, can be utilized as appropriate.

The aluminum substrate used in the present invention has a thickness of about 0.1–0.6 mm. However, this thickness can be changed appropriately depending on the printing machine size, the printing plate size and the requests of users.

It is appropriate that the aluminum substrate be subjected to surface treatments as described below.

The surface of an aluminum substrate used in the present invention can undergo graining treatment. The graining treatment can be effected using various methods, such as a mechanical graining method, a chemical etching method and an electrolytic graining method. Further, it is possible to adopt a method of carrying out graining treatment electrochemically in an electrolyte, such as hydrochloric acid or nitric acid, or a mechanical graining method. Examples of a mechanical graining method usable herein include a wire brush graining method in which the aluminum surface is brushed with metallic wires, a ball graining method in which the aluminum surface is grained with balls and abrasives, and a brush graining method in which the aluminum surface is grained with a nylon brush and abrasives. These graining methods can be employed alone or as a combination of two or more thereof.

Of the methods described above, the method of graining electrochemically in an electrolytic solution of hydrochloric acid or nitric acid is preferred over the others in providing the surface roughness useful for the present invention. The suitable current density therein is from 100 to 400 C/dm$^2$. More specifically, the electrolysis for graining can be effectively carried out in an electrolytic solution containing 0.1 to 50 weight % of hydrochloric acid or nitric acid under conditions that the electrolysis temperature is from 20 to 100° C., the electrolysis time is from 1 second to 30 minutes and the current density is from 100 to 400 C/dm$^2$.

In addition, it is also appropriate to combine such an electrochemical graining method with a mechanical graining method.

The aluminum substrate subjected to the graining treatment is etched chemically with an acid or an alkali. When the etching agent used is an acid, it becomes a time-consuming work to destroy the fine structure, so the use of an acid as the etching agent is disadvantageous for the application of the present invention on an industrial scale. The use of an alkali as the etching agent can alleviate such a disadvantage.

Examples of an alkali agent suitably used in the present invention include sodium hydroxide, sodium carbonate, sodium aluminate, sodium metasilicate, sodium phosphate, potassium hydroxide and lithium hydroxide. The suitable concentration and temperature for the alkali etching are in the ranges of 1 to 50 weight % and 20 to 100° C. respectively. And the conditions under which the amount of aluminum dissolved comes to range from 5 to 20 g/m$^2$ are preferred.

After etching, the smut remaining on the surface is removed by pickling. Examples of an acid usable for the pickling include nitric acid, sulfuric acid, phosphoric acid, chromic acid, hydrofluoric acid and hydroborofluoric acid. After the graining treatment is carried out electrochemically in particular, it is appropriate to perform the smut removal by using the method of bringing the etched surface in contact with a 15 to 65 weight % sulfuric acid solution heated to a temperature of 50 to 90° C. as disclosed in JP-A-53-12739 or the method of etching with an alkali as disclosed in JP-B-48-28123.

The thus treated aluminum substrate is further subjected to anodic oxidation treatment.

The anodic oxidation treatment can be effected using methods hitherto adopted in this field. Specifically, direct current or alternating current is passed through the aluminum substrate in an aqueous or non-aqueous solution containing sulfuric acid, phosphoric acid, chromic acid, oxalic acid, sulfaminic acid, benzenesulfonic acid, or a mixture of two or more of those acids. Thus, an anodic oxidation layer can be formed on the aluminum substrate surface.

The conditions for anodic oxidation treatment change variously depending on the electrolyte used, so they cannot be generalized. However, according to normal standards of anodic oxidation, the appropriate electrolyte concentration is from 1 to 80 weight %, the electrolytic solution temperature is from 5to 70° C., the current density is from 0.5to 60 ampere/dm$^2$, the voltage is from 1 to 100 V and the electrolysis time is from 10 to 100 seconds.

Of these anodic oxidation treatments, the method disclosed in British Patent 1,412,768, wherein the anodic oxidation is carried out in sulfuric acid under a high current density condition, is preferred over the others.

The suitable coverage of anodic oxidation layer in the present invention is from 1 to 10 g/m$^2$. When the coverage is less than 1 g/m$^2$, the plate is liable to be injured; while the coverage increased is more than 10 g/m$^2$ requires high consumption of electricity, so it is disadvantageous from the economical point of view. It is preferable for the coverage of anodic oxidation layer to be from 1.5 to 7.0 g/m$^2$, particularly from 2 to 5 g/m$^2$.

The thus formed anodic oxidation layer has fine concave parts referred to as micropores which are uniformly distributed over the surface. The density of micropores present at the anodic oxidation layer surface can be controlled by properly selecting the treatment conditions.

The treatment for widening the pore diameters of micropores present at the anodic oxidation layer surface (pore-widening treatment), which is one of the characteristics of the present invention, is effected by immersing the anodic oxidation layer-formed aluminum substrate in an aqueous acid or alkali solution and dissolving the anodic oxidation layer in the solution. This pore-widening treatment is carried out under a condition that the amount of anodic oxidation layer dissolved falls within the range of 0.05 to 20 g/m2, preferably 0.1 to 5 g/m$^2$, particularly preferably 0.2 to 4 g/m$^2$. It is desirable that the average diameter of micropores be from 6 to 40 nm, preferably 30 nm or below, particularly preferably 20 nm or below.

More specifically, the following are condition ranges that the pore-widening treatment for dissolving the anodic oxidation layer can be effected. When the conditions fall outside these ranges, there occurs a problem that the time required for dissolution becomes very long to lower the working efficiency, or conversely the dissolution is completed in an extremely short time to render the practical dissolution control impossible. In the case of treatment with an aqueous acid solution, it is appropriate to use an aqueous solution of inorganic acid, such as sulfuric acid, phosphoric acid or a mixture of these acids, the suitable acid concentration is from 10 to 500 g/l, preferably 20 to 100 g/l, the suitable solution temperature is from 10 to 90° C., preferably from 40 to 70° C., and the suitable immersion time is from 10 to 300 seconds, preferably from 30 to 120 seconds. In the case of treatment with an aqueous alkali solution, on the other hand, it is appropriate to use an aqueous solution of sodium hydroxide, potassium hydroxide, lithium hydroxide or a mixture of two or more of these hydroxides, the suitable pH of the solution is from 11 to 13, preferably from 11.5 to 12.5, the suitable solution temperature is from 10 to 90° C., preferably from 30 to 50° C., and the suitable immersion time is from 5 to 300 seconds, preferably from 10 to 30 seconds.

When the pore diameters of micropores of the anodic oxidation layer is widened, the thermal conductivity of the anodic oxidation layer is lowered. As a result, the diffusion of heat generated in the upper layer is reduced, and the thermal fusion or thermal reaction of fine particles contained in the upper layer is promoted to result in press life improvement. In return for such improvement, scumming problems, inclusive of deterioration in ink eliminability, are generated. More specifically, when the pore diameter is widened, a phenomenon that the ink is hard to remove from a printing plate (deterioration in ink eliminability) are liable to occur during the printing operation, especially at the time when the printing operation is resumed after the printing operation was brought to a halt and the printing plate has been left standing on the printing machine.

The solution to this problem features in the present invention, and it comprises using a substrate having an average pore diameter controlled to the specified range, or a substrate having performed a pore-widening treatment first and then an immersion treatment in an aqueous solution containing a hydrophilic compound, or a substrate having a pore-widened anodic oxidation layer surface on which is coated with a subbing layer comprising a water-soluble resin containing carboxyl or carboxylato groups and a water-soluble salt containing at least one metal selected from the group consisting of zinc, calcium, magnesium, barium, strontium, cobalt, manganese and nickel. In order to control the average pore diameter to the specified range, pore-sealing treatment may be performed after pore-widening treatment. In the case of carrying out treatment for imparting water receptivity, it is desirable that the pore diameter after the treatment be 40 nm or below, preferably 20 nm or below, particularly preferably 10 nm or below. The pore-widening treatment, the pore-sealing treatment, the immersion treatment in an aqueous solution containing a hydrophilic compound and the coating of the subbing layer can be carried out in combination. By taking at least one of these measures, compatibility between improvement in press life and increase in scumming resistance, inclusive of ink eliminability, can be achieved.

The pore-sealing treatment applied after the pore-widening treatment for the foregoing purpose can be effected using known methods, such as hydrothermal treatment, boiling water treatment, steam treatment, dichromate treatment, nitrite treatment, ammonium acetate treatment and electrodeposition treatment.

The methods applicable to hydrothermal treatment, boiling water treatment and steam treatment are known in many references including JP-A-4-176690 and JP-A-5-131773.

The temperature range suitable for these treatments is from about 95° C. to about 200° C., preferably from about 100° C. to about 150° C. The time range suitable for the treatment at 100° C. is from about 5 to about 150 seconds, and that for the treatment at 150° C. is from about 1 to about 30 seconds.

As another pore-sealing treatment, the fluorozirconate treatment disclosed in JP-A-36-22063 can be employed. As still another pore-sealing treatment, the method disclosed in JP-A-9-244227 wherein the treatment is carried out in an aqueous solution containing a phosphate or an inorganic fluorine compound can be adopted. Further, it is possible to adopt the method disclosed in JP-A-9-134002 wherein the treatment is carried out in an aqueous solution containing sugar.

In addition, the methods described in JP-A-81704/2000 and JP-A-89466/2000 wherein an aqueous solution containing titanium and fluorine is used for the treatment are also applicable.

Furthermore, the treatment with an alkali metal silicate may be applied to the pore-sealing treatment. In this case, the methods as disclosed, e.g., in U.S. Pat. No. 3,181,461 can be adopted.

In the alkali metal silicate treatment, an aqueous solution of alkali metal silicate adjusted to pH 10–14 at 25° C. is used with the view of avoiding the gelation of the solution and the dissolution of anodic oxidation layer, and the treatment conditions for pore sealing treatment, including an alkali metal silicate concentration, a treatment temperature and treatment time, are selected as appropriate. Examples of an alkali metal silicate suitably used therein include sodium silicate, potassium silicate and lithium silicate.

In addition, the aqueous solution of alkali metal silicate may be mixed with sodium hydroxide, potassium hydroxide or/and lithium hydroxide so that the pH thereof is adjusted to a higher value.

In the aqueous solution of alkali metal silicate, alkaline earth metal salts or the group IVB metal salts may further be mixed, if needed. Such alkaline earth metal salts are water-soluble salts, with examples including nitrates, such as calcium nitrate, strontium nitrate, magnesium nitrate and barium nitrate, and sulfates, hydrochlorides, phosphates, acetates, oxalates and borates of alkaline earth metals as described above. Examples of salts of the group IVB metals, include titanium tetrachloride, titanium trichloride, potassium titanium fluoride, potassium titanium oxalate, titanium sulfate, titanium tetraiodide, zirconium chloroxide, zirconium dioxide, zirconium oxychloride and zirconium tetrachloride. Those alkaline earth metal salts and those group IVB metal salts can be used alone or as a mixture of two or more thereof. The suitable proportion of such metal salts mixed is from 0.01 to 10 weight %, preferably from 0.05 to 5.0 weight %.

By the anodic oxidation treatment and the pore-widening treatment in an aqueous acid or alkali solution, or the pore-widening treatment and the pore-sealing treatment subsequent thereto, the average diameter of micropores present in the anodic oxidation layer can be controlled to the range of 6 to 40 nm, preferably 6 to 20 nm. When the average diameter of micropores is outside the range specified above, the compatibility between good ink eliminability and sufficient press life cannot be attained.

Next is described the immersion treatment in an aqueous solution containing a hydrophilic compound which is carried out after the pore-widening treatment of the present invention.

Examples of such a hydrophilic compound, include polyvinylphosphonic acid, compounds containing sulfonic acid groups, and saccharide compounds.

In the compounds containing sulfonic acid groups are included aromatic sulfonic acids, condensation products of aromatic sulfonic acids and formaldehyde, and derivatives and salts of aromatic sulfonic acids. Examples of an aromatic sulfonic acid usable herein include phenolsulfonic acid, catecholsulfonic acid, resorcinolsulfonic acid, benzenesulfonic acid, toluenesulfonic acid, ligninsulfonic acid, naphthalenesulfonic acid, acenaphthene-5-sulfonic acid, phenanthrene-2-sulfonic acid, benzaldehyde-2(or 3)-sulfonic acid, benzaldehyde-2,4(or 3,5)-disulfonic acid, oxybenzylsulfonic acids, sulfobenzoic acid, sulfanilic acid, naphthionic acid and taurine. Of these acids, benzenesulfonic acid, naphthalenesulfonic acid, ligninsulfonic acid and formaldehyde condensates of these acids are preferred over the others. These sulfonic acids may be used in the form of salts. For instance, they can be converted to sodium salts, potassium salts, lithium salts, calcium salts or magnesium salts. In particular, it is advantageous to use aqueous solutions of sodium or potassium salts of those sulfonic acids.

The suitable pH of such aqueous solutions is from 4 to 6.5, and the adjustment to this pH range can be made using, e.g., sulfuric acid, sodium hydroxide or/and ammonia.

Examples of a saccharide compound usable in the present invention include monosaccharides, sugar alcohols, oligosaccharides, polysaccharides and glycosides.

Examples of monosaccharides, include trioses (e.g., glycerol) and sugar alcohols derived therefrom, tetroses (e.g., threose, erythritol) and sugar alcohols derived therefrom, pentoses (e.g., arabinose, arabitol) and sugar alcohols derived therefrom, hexoses (e.g., glucose, sorbitol) and sugar alcohols derived therefrom, heptoses (e.g., D-glycero-D-galactoheptose, D-glycero-D-galactoheptitol) and sugar alcohols derived therefrom, octoses (e.g., D-erythro-D-galactooctitol), and nonoses (e.g., D-erythro-L-gluconononurose). Examples of oligosaccharides, include disaccharides such as saccharose, trehalose and lactose, and trisaccharides such as raffinose. Examples of polysaccharides, include amylose, arabinan, cyclodextrin and cellulose alginate.

The glycosides usable in the present invention are compounds having a structure that a saccharide moiety is bonded by, e.g., an ether linkage to a non-saccharide moiety. These glycosides can be classified according to the kinds of non-saccharide moieties present therein. Examples thereof include alkyl glycosides, phenol glycosides, coumarin glycosides, oxycoumarin glycosides, flavonoid glycosides, anthraquinone glycosides, triterpene glycosides, steroid glycosides or mustard oil glycosides. The saccharide moieties therein are monosaccharide, oligosaccharide or polysaccharide moieties. Examples of monosaccharide as a constituent of glycoside include trioses (e.g., glycerol) and sugar alcohols derived therefrom, tetroses (e.g., threose, erythritol) and sugar alcohols derived therefrom, pentoses (e.g., arabinose, arabitol) and sugar alcohols derived therefrom, hexoses (e.g., glucose, sorbitol) and sugar alcohols derived therefrom, heptoses (e.g., D-glycero-D-galactoheptose, D-glycero-D-galactoheptitol) and sugar alcohols derived therefrom, octoses (e.g., D-erythro-D-galactooctitol), and nonoses (e.g., D-erythro-L-gluconononurose). Examples of oligosaccharide as a constituent of glycoside include disaccharides such as saccharose, trehalose and lactose, and trisaccharides such as raffinose. Examples of polysaccharide as a constituent of glycoside include amylose, arabinan, cyclodextrin and cellulose alginate. As the saccharide moiety, monosaccharide and oligosaccharide moieties are suitable. Of these moieties, monosaccharide and disaccharide moieties are preferred over the others. Suitable examples of glycoside include compounds represented by the following formula (I):

(I)

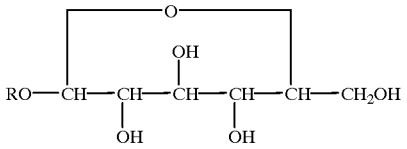

wherein R represents a straight-chain, branched or cyclic alkyl group containing 1 to 20 carbon atoms, an alkenyl group or an alkynyl group.

Examples of an alkyl group having 1 to 20 carbon atoms represented by R in formula (I) include methyl, ethyl, propyl, isopropyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl and eicosyl groups. These alkyl groups may have a straight-chain, branched or cyclic form. Examples of the alkenyl group as R include allyl and 2-butenyl groups. And 1-pentynyl group is exemplified as an example of the alkynyl group as R.

Examples of a compound represented by formula (I) include methyl glucoside, ethyl glucoside, propyl glucoside, isopropyl glucoside, butyl glucoside, isobutyl glucoside, n-hexyl glucoside, octyl glucoside, capryl glucoside, decyl glucoside, 2-ethylhexyl glucoside, 2-pentylnonyl glucoside, 2-hexyldecyl glucoside, lauryl glucoside, myristyl glucoside, stearyl glucoside, cyclohexyl glucoside and 2-butynyl glucoside.

These compounds are glucosides as a variety of glycosides. More specifically, glucosides are ether compounds produced by reacting the hemiacetal hydroxyl group of grape sugar with other compounds respectively. For instance, they can be produced by reacting glucose with alcohols in accordance with a known method. Some of these glucosides are marketed under the trade name of GLUCOPON from German Henkel A.G., and they can be used in the present invention. Suitable examples of other glycosides include saponin, rutin trihydrate, hesperidin methylchalcone, hesperidin, naringin hydrate, phenol-β-D-glucopyranoside, salicin and 3',5,7-methoxy-7-rutinoside.

The pH adjustment of aqueous solutions containing compounds as described above can be made using potassium hydroxide, sulfuric acid, carbonic acid, sodium carbonate, phosphoric acid or/and sodium phosphate, and it is appropriate that the pH adjusted be within the range of 8 to 11.

As to the aqueous solution of polyvinylsulfonic acid, the suitable concentration thereof is from 0.1 to 5% by weight, preferably from 0.2 to 2.5% by weight. Therein, the suitable immersion temperature is from 10 to 70° C., preferably from 30 to 60° C., and the suitable immersion time is from 1 to 20 seconds.

As to the aqueous solutions of sulfonic acid-containing compounds, the suitable concentration thereof is from 0.02 to 0.2% by weight. Therein, the suitable immersion temperature is from 60 to 100° C., and the suitable immersion time is from 1 to 300 seconds, preferably from 10 to 100 seconds.

As to the aqueous solutions of saccharides, the suitable concentration thereof is from 0.5 to 10% by weight. Therein, the suitable immersion temperature is from 40 to 70° C., and the suitable immersion time is from 2 to 300 seconds, preferably from 5 to 30 seconds.

For the present invention, it is advantageous to carry out not only the treatment with an aqueous solution of organic compound as described above but also treatment with an aqueous solution of inorganic compound, such as an aqueous solution of alkali metal silicate, an aqueous solution of potassium zirconium fluoride ($K_2ZrF_6$) or an aqueous solution of phosphate/inorganic fluorine compound mixture.

For the treatment in an aqueous solution of alkali metal silicate, it is appropriate to use the aqueous solution ranging in alkali metal silicate concentration of from 1 to 30 weight %, preferably from 2 to 15 weight %, having a pH value of 10 to 13 at 25° C. and being heated up to a temperature of 50 to 90° C., and to control the immersion time to the range of 0.5 to 40 seconds, preferably 1 to 20 seconds. The aqueous solution of alkali metal silicate sets to gel when the pH thereof is lowered to below 10, while it causes dissolution of anodic oxidation layer when the pH thereof is heightened to above 13.

As the alkali metal silicate, sodium silicate, potassium silicate and lithium silicate are usable, but sodium silicate and potassium silicate are preferable in the present invention. The pH of an aqueous solution of alkali metal silicate can be raised by addition of a hydroxide, such as sodium hydroxide, potassium hydroxide or lithium hydroxide. For raising the pH in the present invention, however, it is preferable to use sodium hydroxide or potassium hydroxide. In the foregoing treatment solution, alkaline earth metal salts or the group IVB metal salts may further be mixed. Examples of such alkaline earth metal salts, include water-soluble salts, inclusive of nitrates, such as calcium nitrate, strontium nitrate, magnesium nitrate and barium nitrate, sulfates, hydrochlorides, phosphates, acetates, oxalates and borates. Examples of salts of the group IVB metals, include titanium tetrachloride, titanium trichloride, potassium titanium fluoride, potassium titanium oxalate, titanium sulfate, titanium tetraiodide, zirconium chloroxide, zirconium dioxide, zirconium oxychloride and zirconium tetrachloride. Those alkaline earth metal salts and those group IVB metal salts can be used alone or as a mixture of two or more thereof.

In the treatment with an aqueous solution of potassium zirconium fluoride, the suitable concentration of the solution is from 0.1 to 10 weight %, preferably from 0.5 to 2 weight %, the suitable immersion temperature is from 30 to 80° C. and the suitable immersion time is from 60 to 180 seconds.

In the treatment with a phosphate/inorganic fluorine compound mixture, it is appropriate to use an aqueous solution containing a phosphate compound in a concentration of 5 to 20 weight % and an inorganic fluorine compound in a concentration of 0. 01 to 1 weight %, and to adjust the solution to pH 3–5. Therein, the suitable immersion temperature is from 30 to 90° C. and the suitable immersion time is from 2 to 300 seconds, preferably from 5 to 30 seconds.

The phosphates usable in the foregoing treatment include phosphoric acid salts of alkali metals or alkaline earth metals. Examples of these salts, include zinc phosphate, aluminum phosphate, ammonium phosphate, diammonium hydrogenphosphate, ammonium dihydrogenphosphate, ammonium phosphate, potassium phosphate, sodium phosphate, potassium dihydrogenphosphate, dipotassium hydrogenphosphate, calcium phosphate, sodium ammonium hydrogenphosphate, magnesium hydrogenphosphate, magnesium phosphate, iron(II) phosphate, iron(III) phosphate, sodium phosphate, sodium dihydrogenphosphate, disodium hydrogenphosphate, lead phosphate, diammonium phosphate, calcium dihydrogenphosphate, lithium phosphate, phosphorus wolframate, ammonium phosphowolframate, sodium phosphowolframate, ammonium phosphomolybdate and sodium phosphomolybdate. In addition, sodium phosphite, sodium tripolyphosphate and sodium pyrophosphate can also be used. Of those phosphates, sodium dihydrogenphosphate, disodium hydrogenphosphate, potassium dihydrogenphosphate and dipotassium hydrogenphosphate are preferred over the others.

The inorganic fluorine compounds appropriately used in the present invention are metal fluorides. Examples of such compounds, include sodium fluoride, potassium fluoride, calcium fluoride, magnesium fluoride, sodium hexafluorozirconate, potassium hexafluorozirconate, sodium hexafluorotitanate, potassium hexafluorotitanate, hexafluorozirconium hydroacid, hexafluorotitanium hydroacid, ammonium hexafluorozirconate, ammonium hexafluorotitanate, hexafluorosilicic acid, nickel fluoride, iron fluoride, fluorophosphoric acid and ammonium fluorophosphate.

In the present invention, one or more of the phosphates as described above and one or more of the inorganic fluorine compounds as described above may be contained in the aqueous solution for treatment.

After immersion treatment in each of the aqueous solutions described above, the substrate is washed with water or the like, and dried.

Then, a subbing layer which can be coated on the anodic oxidation layer after the pore-widening treatment characteristic of the present invention is described.

The subbing layer comprises a water-soluble resin containing carboxyl or carboxylato groups and at least one water-soluble salt of metal selected from the group consisting of zinc, calcium, magnesium, barium, strontium, cobalt, manganese and nickel.

Examples of a water-soluble, carboxyl or carboxylato group-containing resin suitable for the present subbing layer include polyacrylic acid, sodium aliginate, carboxylic acid-modified starch and water-soluble salts of carboxyalkyl celluloses. As the water-soluble salts of carboxyalkyl celluloses, potassium or sodium salts of carboxymethyl cellulose, carboxyethyl cellulose and carboxypropyl cellulose are suitable.

Other examples of a water-soluble, carboxyl or carboxylato group-containing resin suitable for the present subbing layer include copolymers prepared from carboxyl group-containing monomers and other monomers, such as an acrylamide-(meth)acrylic acid copolymer, a vinyl pyrrolidone-(meth)acrylic acid copolymer, hydrolysis products of a vinyl acetate-maleic anhydride copolymer and a hydroxyalkyl (meth)acrylate-(meth)acrylic acid copolymer, and water-soluble salts, such as sodium or potassium salts, of copolymers as described above.

The water-soluble metal salts suitable for the present subbing layer are water-soluble salts made by reacting organic or inorganic acids with metal ions selected from the group consisting of zinc, calcium, magnesium, barium, strontium, cobalt, manganese and nickel ions. The representatives of such organic acid salts are salts of carboxylic acids, such as salicylic acid, benzoic acid, acetic acid, propionic acid, butyric acid and fumaric acid. And the representatives of such inorganic acid salts include bromates, bromides, chlorates, chlorides, dithionates, iodides, nitrates and sulfates.

The subbing layer constituted of a water-soluble resin containing carboxyl or carboxylato groups and a water-soluble metal salt as described above may be provided by coating a solution containing a mixture of those two constituents, or by coating a water-soluble resin solution first and then coating a water-soluble metal salt solution, or coating these solutions separately in a retrograded order.

The suitable coating composition for the subbing layer (subbing solution) can be prepared as an aqueous solution. To the subbing solution, an organic solvent, such as alcohol or ketone, may be added, if needed.

The suitable solids concentration of the subbing solution is from 0.15 to 0.75 weight % (specifically, the water-soluble resin concentration is from about 0.1 to about 0.5 weight % and the water-soluble metal salt concentration is from about 0.05 to about 25 weight %), preferably from 0.2 to 0.6 weight %.

The suitable dry coverage of the subbing layer is from 1 to 100 $mg/m^2$, preferably from 5 to 50 $mg/m^2$ When the subbing layer has its dry coverage in the foregoing range, satisfactory ink eliminability and adhesion to a hydrophilic layer can be obtained.

Prior to coating a hydrophilic layer after the pore-sealing treatment or the immersion treatment in an aqueous solution of hydrophilic compound, it is also possible, if desired, to provide a subbing layer different from the foregoing subbing layer, e.g., an inorganic subbing layer comprising a water-soluble metal salt such as zinc borate or an organic subbing layer as described below.

Examples of an organic compound usable for the organic subbing layer include carboxymethyl cellulose, dextrin, gum arabic, homo- and copolymers having sulfonic acid groups in their side chains, polyacrylic acid, amino group-containing phosphonic acids (such as 2-aminoethylphosphonic acid), organic phosphonic acids (such as unsubstituted or substituted phenylphosphonic acid, naphthylphosphonic acid, alkylphosphonic acid, glycerophosphonic acid, methylenediphosphonic acid and ethylenediphosphonic acid), organic phosphoric acids (such as unsubstituted or substituted phenylphosphoric acid, naphthylphosphoric acid, alkylphosphoric acid and glycerophosphoric acid), organic phosphinic acids (such as unsubstituted or substituted phenylphosphinic acid, naphthylphosphinic acid, alkylphosphinic acid and glycerophosphinic acid), amino acids (such as glycine and β-alanine), hydrochlorides of hydroxyl group-containing amines (such as triethanolamine hydrochloride), and yellow dyes. These organic compounds may be used alone or as a mixture of two or more thereof.

The organic subbing layer can be provided in the following manner. Specifically, the organic compound as described above is dissolved in water, or an organic solvent, such as methanol, ethanol or methyl ethyl ketone, or a mixture thereof, is coated on an aluminum substrate, and then dried to form the organic subbing layer. Therein, it is appropriate that the organic compound solution range in concentration from 0.005 to 10 weight %, and this solution can be coated using various methods, e.g., bar coater coating, spin coating, spray coating and curtain coating methods.

The suitable dry coverage of the organic subbing layer is from 2 to 200 mg/m$^2$, preferably from 5 to 100 mg/m$^2$.

The present hydrophilic layer contains fine particles of a heat-fusible hydrophobic thermoplastic polymer, fine particles of a polymer having thermally reactive functional groups, or microcapsules in which compounds having heat-reactive functional groups are encapsulated.

It is appropriate that the finely divided hydrophobic thermoplastic polymer usable in the present hydrophilic layer have a solidification temperature of 35° C. or more, preferably 50° C. or more. As to the upper limits of the solidification temperature, the hydrophobic thermoplastic polymer used in the present invention is not particularly restricted. However, the finely divided polymer is required to have a solidification temperature sufficiently lower than its decomposition point. When fine particles of the polymer are heated up to a temperature higher than its solidification temperature, they fuse and coalesce into hydrophobic lumps in the hydrophilic layer. In the areas which come to have such hydrophobic lumps, therefore, the hydrophilic layer becomes insoluble in water or an aqueous liquid, and acquires ink-receptivity.

Examples of a hydrophobic polymer which forms hydrophobic fine particles usable in the hydrophilic layer of the present invention (hereinafter, referred to the present hydrophilic layer) include homopolymers of ethylene, styrene, vinyl chloride, methyl acrylate, ethyl acrylate, methyl methacrylate, ethyl methacrylate, vinylidene chloride, acrylonitrile and vinyl carbazole, and copolymers of at least two different monomers selected from among the monomers described above. These polymers may be used as mixtures of two or more thereof. In particular, polystyrene and polymethyl methacrylate are used to advantage over the other polymers.

It is appropriate that the hydrophobic polymer used in the present hydrophilic layer have its weight average molecular weight in the range of 5,000 to 1,000,000.

The suitable size of the present hydrophobic fine particles is from 0.01 to 50 μm, preferably from 0.05 to 10 μm, particularly preferably from 0.05 to 2 μm.

It is advantageous to add fine particles of hydrophobic thermoplastic polymer to a hydrophilic layer in a proportion of at least 50 weight %, preferably at least 60 weight %, to the total solid contents of the hydrophilic layer.

Examples of the thermally reactive functional groups present in fine particles of a polymer having thermally reactive functional groups or a thermally reactive group-containing compound encapsulated in microcapsules which are incorporated in the present hydrophilic layer, include an ethylenically unsaturated group undergoing polymerization reaction (e.g., acryloyl, methacryloyl, vinyl, allyl), an isocyanate group undergoing addition reaction or a blocked group thereof and an active hydrogen-containing functional group as the other reactant in the addition reaction (e.g., amino, hydroxyl, carboxyl), an epoxy group undergoing addition reaction and an amino, carboxyl or hydroxyl group as the other reactant in the addition reaction, a carboxyl group undergoing condensation reaction with a hydroxyl or amino group, an acid anhydride group undergoing ring-opening addition reaction with an amino or hydroxyl group, and a diazonium group capable of reacting with, e.g., hydroxyl group when decomposed by heat. However, any functional groups may be introduced in the foregoing polymer and compound irrespective of what type of reaction they participate in as far as they can form chemical bonds under heating.

Examples of a polymer having thermally reactive functional groups added in the form of fine particles to the present hydrophilic layer include polymers having acryloyl groups, methacryloyl groups, vinyl groups, allyl groups, epoxy groups, amino groups, hydroxyl groups, carboxyl groups, isocyanate groups, acid anhydride groups or blocked groups thereof. The functional groups described above can be introduced into polymer particles at the stage of polymerization or by utilization of macromolecular reaction (i.e., a high molecular reaction) after polymerization.

In the case where thermally reactive functional groups are introduced at the time of polymerization, it is advantageous to subject monomers having such functional groups to emulsion or suspension polymerization. Thereto, monomers free of thermally reactive functional groups may be added as copolymerizing components.

Examples of monomers having such functional groups include allyl methacrylate, allyl acrylate, vinyl methacrylate, vinyl acrylate, glycidyl methacrylate, glycidyl acrylate, 2-isocyanatoethyl methacrylate whose isocyanate group may be blocked by an alcohol, 2-isocyanatoethyl acrylate whose isocyanate group may be blocked by an alcohol, 2-aminoethyl methacrylate, 2-aminoethyl acrylate, 2-hydroxyethyl methacrylate, 2-hydroxyethyl acrylate, acrylic acid, methacrylic acid, maleic anhydride, difunctional acrylate and difunctional methacrylate. However, these examples should not be construed as limiting the monomers applicable to the foregoing polymerization reactions.

Examples of thermally reactive functional group-free monomers which can be copolymerized with the monomers described above include styrene, alkyl acrylate, alkyl methacrylate, acrylonitrile and vinyl acetate. However, any monomers can be employed as far as they are free of thermally reactive functional groups.

As an example of macromolecular reaction applicable to the introduction of thermally reactive functional groups after polymerization, the macromolecular reaction disclosed in WO96-34316 is exemplified.

Of those polymers having thermally reactive functional groups, the polymers having the property of coalescing among fine particles thereof under heating are preferred, and they become more suitable when fine particles thereof have hydrophilic surfaces and are dispersible in water. Further, it is advantageous for these polymers to have a property that the film formed by drying a coating of finely divided polymer alone at a temperature lower than its solidification temperature has a lower contact angle (with a waterdrop in the air) than the film formed by drying the coating at a temperature higher than its solidification temperature. For rendering the finely divided polymer surface hydrophilic, it is appropriate that a hydrophilic polymer, such as polyvinyl alcohol or polyethylene glycol, an oligomer or a hydrophilic low molecular compound be adsorbed to the finely divided polymer surface However, other methods may be adopted therefor.

It is advantageous for these finely divided polymers containing thermally reactive functional groups to have a solidification temperature of 70° C. or above, preferably 100° C. or above in view of storage stability.

Further, it is advantageous for those finely divided polymers to have an average particle size of 0.01 to 20 $\mu$m, preferably 0.05 to 2.0 $\mu$m, particularly preferably 0.1 to 1.0 $\mu$m. When the average particle size is too large, the resolution is lowered; while, when it is too small, the storage stability is decreased.

The suitable proportion of these finely divided polymers having reactive functional groups to the total solid contents of the hydrophilic layer is at least 50 weight %, preferably at least 60 weight %.

The microcapsules used in the present invention encapsulate a compound having a thermally reactive functional group. For instance, such a compound includes a compound having at least one functional group selected from polymerizable unsaturated groups, hydroxyl group, carboxyl, carboxylato or acid anhydride groups, amino groups, epoxy groups, isocyanate groups or blocked isocyanate groups.

The suitable compounds as the compounds having polymerizable unsaturated groups are compounds which each have at least one ethylenically unsaturated bond, preferably at least two ethylenic unsaturated bonds, e.g., compounds in which an acryloyl, methacryloyl, vinyl or allyl group is present. Such compounds are well known in this industrial field. They can be used in the present invention without any particular restrictions. As to their chemical structures, they may have the form of a monomer, a prepolymer including a dimer, a trimer and an oligomer, a mixture thereof, or a copolymer.

Examples of those compounds include unsaturated carboxylic acids (such as acrylic acid, methacrylic acid, itaconic acid, crotonic acid, isocrotonic acid and maleic acid) and esters and amides of unsaturated carboxylic acids, preferably esters prepared from unsaturated carboxylic acids and aliphatic polyhydric alcohols, and amides prepared from unsaturated carboxylic acids and aliphatic polyamines.

Further, the products obtained by addition reaction between unsaturated carboxylic acid esters or amides containing nucleophilic substituents, such as hydroxyl, amino and mercapto groups, and monofunctional or polyfunctional isocyanates or epoxides, as well as the products obtained by dehydration condensation reaction between unsaturated carboxylic acid esters or amides containing the nucleophilic substituents described above and monofunctional or polyfunctional carboxylic acids can be employed appropriately.

In addition, the products obtained by addition reaction between unsaturated carboxylic acid esters or amides containing electrophilic substituents, such as isocyanate and epoxy groups, and monofunctional or polyfunctional alcohols, amines or thiols, as well as the products obtained by replacement reaction between unsaturated carboxylic acid esters or amides containing releasing groups, such as halogen and tosyloxy groups, and monofunctional or polyfunctional alcohols, amines or thiols are also suitably used.

Still other suitable examples include compounds having a chemical structure that the unsaturated carboxylic acid part in each of the compounds as described above is replaced by an unsaturated phosphonic acid or chloromethylstyrene.

Examples of a polymerizable compound as the ester of an unsaturated carboxylic acid and an aliphatic polyhydric alcohol, include acrylic acid esters, such as ethylene glycol diacrylate, triethylene glycol diacrylate, 1,3-butanediol diacrylate, tetramethylene glycol diacrylate, propylene glycol diacrylate, neopentyl glycol diacrylate, trimethylolpropane diacrylate, trimethylolpropane triacrylate, trimethylolpropane tris(acryloyloxypropyl)ether, trimethylolethane triacrylate, hexanediol diacrylate, 1,4-cyclohexanediol diacrylate, tetraethylene glycol diacrylate, pentaerythritol diacrylate, pentaerythritol triacrylate, pentaerythritol tetraacrylate, dipentaerythritol diacrylate, dipentaerythritol pentaacrylate, dipentaerythritol hexaacrylate, sorbitol triacrylate, sorbitol tetraacrylate, sorbitol pentaacrylate, sorbitol hexaacrylate, tris(acryloyloxyethyl)isocyanurate and polyester acrylate oligomers; methacrylic acid esters, such as tetramethylene glycol dimethacrylate, triethylene glycol dimethacrylate, neopentyl glycol dimethacrylate, trimethylolpropane trimethacrylate, trimethylolethane trimethacrylate, ethylene glycol dimethacrylate, 1,3-butanediol dimethacrylate, hexanediol dimethacrylate, pentaerythritol dimethacrylate, pentaerythritol trimethacrylate, pentaerythritol tetramethacrylate, dipentaerythritol dimethacrylate, dipentaerythritol hexamethacrylate, sorbitol trimethacrylate, sorbitol tetramethacrylate, bis[p-(3-methacryloyloxy-2-hydroxypropoxy)phenyl]dimethylmethane and bis-[p-(methacryloyloxyethoxy)phenyl]dimethylmethane; itaconic acid esters, such as ethylene glycol diitaconate, propylene glycol diitaconate, 1,3-butanediol diitaconate, 1,4-butanediol diitaconate, tetramethylene glycol diitaconate, pentaerythritol diitaconate and sorbitol tetraitaconate; crotonic acid esters, such as ethylene glycol dicrotonate, tetramethylene glycol dicrotonate, pentaerythritol dicrotonate and sorbitol tetradicrotonate; isocrotonic acid esters, such as ethylene glycol diisocrotonate, pentaerythritol diisocrotonate and sorbitol tetraisocrotonate; and maleic acid esters, such as ethylene glycol dimaleate, triethylene glycol dimaleate, pentaerythritol dimaleate and sorbitol tetramaleate.

Examples of other esters include the aliphatic alcohol esters as disclosed in JP-B-46-27926, JP-B-51-47334 and JP-A-57-196231, the esters having aromatic skeletons disclosed in JP-A-59-5240, JP-A-59-5241 and JP-A-2-226149, and the amino group-containing esters disclosed in JP-A-1-165613.

Examples of an amide monomer prepared from an aliphatic polyamine compound and an unsaturated carboxylic acid, include methylenebis(acrylamide), methylenebis(methacrylamide), 1,6-hexamethylenebis(acrylamide), 1,6-hexamethylenebis(methacrylamide), diethylene-triaminetris(acrylamide), xylylenebis(acrylamide) and xylylenebis(methacrylamide).

Examples of other suitable amide monomers include the amides having a cyclohexylene structure as disclosed in JP-B-54-21726.

Further, urethane-type addition polymerizable compounds produced by addition reaction between isocyanate and hydroxyl group are also suitably used. Examples of such compounds include urethane compounds containing at least two polymerizable unsaturated groups per molecule, which are produced by addition of a hydroxyl group-containing unsaturated monomer represented by the following formula (I) to the polyisocyanate compounds having at least two isocyanate groups per molecule as disclosed in JP-B-48-41708:

$$CH_2{=}C(R^1)COOCH_2CH(R^2)OH \quad (I)$$

wherein $R^1$ and $R^2$ are each H or $CH_3$.

Furthermore, the urethane acrylates disclosed in JP-A-51-37193, JP-B-2-32293 and JP-B-2-16765, and the urethane compounds having ethylene oxide skeletons as disclosed in JP-B-58-49860, JP-B-56-17654, JP-B-62-39417 and JP-B-62-39418 can be given as suitable examples.

In addition, the radical polymerizable compounds having an amino or sulfide structure in each molecule as disclosed in JP-A-63-277653, JP-A-63-260909 and JP-A-1-105283 can also be given as suitable examples.

Other examples of compounds which can be appropriately encapsulated in microcapsules include the polyester acrylates and polyfunctional acrylates or methacrylates, such as epoxy(meth)acrylates prepared by reacting epoxy resins with (meth)acrylic acid, as disclosed in JP-A-48-64183, JP-B-49-43191 and JP-B-52-30490; the specific unsaturated compound disclosed in JP-A-46-43946, JP-B-1-40337 and JP-B-1-40336; and the vinylphosphonic acid compounds disclosed in JP-A-2-25493. In some cases, the perfluoroalkyl group-containing compounds disclosed in JP-A-61-22048 are also suitable. Furthermore, the compounds introduced as photosetting monomers and oligomers in *Nippon Settyaku Kyoukai-Shi* (translated into English, it means "Journal of Japanese Adhesive Society"), Vol. 20, No. 7, pages 300–308 (1984) can be suitably used, too.

Examples of suitable epoxy compounds include glycerol polyglycidyl ether, polyethylene glycol diglycidyl ether, polypropylene diglydicyl ether, trimethylolpropane polyglycidyl ether, sorbitol polyglycidyl ether, and polyglycidyl ethers of bisphenols, polyphenols or hydrogenation products thereof.

Examples of suitable isocyanate compounds include tolylene diisocyanate, diphenylmethane diisocyanate, polymethylenepolyphenyl polyisocyanate, xylylene diisocyanate, naphthalene diisocyanate, cyclohexanephenylene diisocyanate, isophorone diisocyanate, hexamethylene diisocyanate, cyclohexyl diisocyanate, and compounds obtained by blocking the diisocyanates described above with alcohols or amines.

Examples of suitable amine compounds include ethylenediamine, diethylenetriamine, triethylenetetramine, hexamethylenediamine, propylenediamine and polyethylene-imine.

Examples of suitable compounds containing hydroxyl groups include include compounds having terminal methylol groups, polyhydric alcohols (e.g., pentaerythritol), bisphenol and polyphenols.

Examples of suitable compounds containing carboxyl groups include aromatic polycarboxylic acids, such as pyromellitic acid, trimellitic acid and phthalic acid, and aliphatic polycarboxylic acids, such as adipic acid.

In addition to the compounds described above, the compounds known to be useful for binders of the existing PS plates, which are described, e.g., in JP-B-54-19773, JP-B-55-34929 and JP-B-57-43890, can also be used as suitable compounds containing hydroxyl groups or carboxyl groups.

Examples of suitable acid anhydrides include pyromellitic anhydride and benzophenonetetracarboxylic anhydride.

Examples of suitable copolymers of ethylenic unsaturated compounds include allylmethacrylate copolymers, such as a copolymer of allyl methacrylate and methacrylic acid, a copolymer of allyl methacrylate and ethyl methacrylate, and a copolymer of allyl methacrylate and butyl methacrylate.

Examples of suitable diazo resins include hexafluorophosphate and aromatic sulfonates of diazophenylamine-formaldehyde condensation resin.

For microencapsulation, known methods can be adopted. As methods of producing microcapsules, for instance, there are known the method of utilizing coacervation as disclosed in U.S. Pat. Nos. 2,800,457 and 2,800,458, the method of using interfacial polymerization as disclosed in British Patent 990,443, U.S. Pat. No. 3,287,154, JP-A-38-19574, JP-A-42-446 and JP-A-42-711, the method of using deposition of polymers as disclosed in U.S. Pat. Nos. 3,418,250 and 3,660,304, the method of using an isocyanatepolyol wall material as disclosed in U.S. Pat. No. 3,796,669, the method of using an isocyanate wall material as disclosed in U.S. Pat. No. 3,914,511, the method of using an urea-formaldehyde or urea-formaldehyde-resorcinol wall material as disclosed in U.S. Pat. Nos. 4,001,140, 4,087,376 and 4,089,802, the method of using a melamine-formaldehyde or hydroxycellulose wall material as disclosed in U.S. Pat. No. 4,025,445, the in-situ method utilizing polymerization of monomers as disclosed in JP-A-36-9163 and JP-B-51-9079, the spray drying method as disclosed in British Patent 930,422 and U.S. Pat. No. 3,111,407, and the electrolytic dispersion cooling method as disclosed in British Patents 952,807 and 967,074. However, these methods should not be construed as limiting the methods usable in the present invention.

The microcapsule walls appropriately used in the present invention have a three-dimentionally cross-linked structure and the property of swelling in solvents. From these viewpoints, materials suitable for the microcapsule walls are polyurea, polyurethane, polyester, polycarbonate, polyamide and mixtures of any two or more of these polymers, especially polyurea and polyurethane. Compounds having thermally reactive functional groups may be introduced into the microcapsule walls.

The suitable average size of the present microcapsules is from 0.01 to 20 μm, preferably from 0.05 to 2.0 μm, particularly preferably from 0.10 to 1.0 μm. When the average size is too large, the resolution is lowered; while, when it is too small, deterioration in storage stability is caused.

These microcapsules may or may not coalesce among themselves when heat is applied thereto. The essential thing is in that, of the compounds encapsulated in each microcapsule, one compound can seep through the microcapsule wall or ooze out of each microcapsule at the time of coating and cause a chemical reaction by the action of heat, or a compound can penetrate into the interior of each microcapsule at the time of coating and cause a chemical reaction by the action of heat. And such a compound may react with a hydrophilic resin or a low molecular compound added. On the other hand, at least two different functional groups capable of thermally reacting with each other may be introduced into separate microcapsules, and thermal reaction may be caused between the resultant microcapsules.

Therefore, it is appropriate for image formation that the present microcapsules coalesce thermally among themselves, but it is not essential.

The suitable proportion of microcapsules incorporated in a hydrophilic layer is at least 50 weight %, preferably at least 60 weight %, to the total solid contents of the hydrophilic layer.

In incorporating microcapsules into the hydrophilic layer, solvents in which contents in the microcapsules can dissolve and the microcapsule wall can swell may be added to a microcapsule-dispersing medium. By such solvents, the diffusion of a thermally reactive functional group-containing compound as one of the contents into the outside of microcapsules can be promoted.

These solvents can be selected easily from many commercially available ones depending on the microcapsule-dispersing medium, the microcapsule wall material, the wall thickness and the contents in microcapsules. In the case of water-dispersible microcapsules having cross-linked polyurea or polyurethane wall, for instance, alcohols, ethers, acetals, esters, ketones, polyhydric alcohols, amides, amine and fatty acids are preferred as those solvents.

Examples of specific compounds as the solvents include methanol, ethanol, tertiary butanol, n-propanol, tetrahydrofuran, methyl lactate, ethyl lactate, methyl ethyl ketone, propylene glycol monomethyl ether, ethylene glycol diethyl ether, ethylene glycol monomethyl ether, γ-butyrolactone, N,N-dimethylformamide and N,N-dimethylacetamide, but these compounds should not construed as limiting the solvents usable therein. Also, these solvents may be used as mixtures thereof.

Solvents which are insoluble in microcapsule-dispersing liquid but become soluble in the dispersing liquid as far as the solvents described above are added thereto can also be used. The suitable amount of such solvents added depends on what materials are used in combination. And the amounts below the suitable range bring about insufficient image formation, while those above the suitable range become a cause of deterioration in dispersion stability. In general, the effective amount range of solvents added is from 5 to 95 weight %, preferably 10 to 90 weight %, particularly preferably 15 to 85 weight %, of a coating composition.

When the finely divided polymer having thermally reactive groups or the microcapsules encapsulating compounds having thermally reactive groups are incorporated in the present hydrophilic layer, compounds capable of initiating or promoting those thermal reactions may be added, if needed.

Examples of a reaction-initiating or promoting compound, include compounds capable of producing radicals or cations under the action of heat, such as lophine dimer, trihalomethyl compounds, peroxides, azo compounds, onium salts including diazonium salts and diphenyliodonium salts, acylphosphine and imidosulfonate.

These compounds can be added in a proportion of 1 to 20 weight %, preferably 3 to 10 weight %, to the total solid contents of the hydrophilic layer. The addition of those compounds in such a proportion range enables satisfactory initiation or promotion of the reaction without impairment of the on-press developability.

To the present hydrophilic layer, hydrophilic resins can be added. By the addition of hydrophilic resins, the on-press developability can be improved, and besides, the hydrophilic layer itself can have enhanced film strength.

Suitable hydrophilic resins are resins having hydrophilic groups, such as hydroxyl, hydroxyethyl, hydroxypropyl, amino, aminoethyl, aminopropyl, amido, carboxyl, carboxymethyl and carboxylato groups.

Examples of a hydrophilic binder polymer include gum arabic, casein, gelatin, starch derivatives, carboxymethyl cellulose and its sodium salt, cellulose acetate, sodium alginate, vinyl acetate-maleic acid copolymers, styrene-maleic acid copolymers, polyacrylic acids and their salts, polymethacrylic acids and their salts, hydroxyethyl methacrylate homopolymer and copolymers, hydroxyethyl acrylate homopolymer and copolymers, hydroxypropyl methacrylate homopolymer and copolymers, hydroxypropyl acrylate homopolymer and copolymers, hydroxybutyl methacrylate homopolymer and copolymers, hydroxybutyl acrylate homopolymer and copolymers, polyethylene glycols, hydroxypropylene polymers, polyvinyl alcohols, hydrolysis-decomposable polyvinyl acetate having a hydrolysis degree of at least 60 weight %, preferably at least 80 weight %, polyvinyl formal, polyvinyl butyral, polyvinyl pyrrolidone, acrylamide homopolymer and copolymers, methacrylamide homopolymer and copolymers, and N-methylolacrylamide homopolymer and copolymers.

The suitable proportion of such a hydrophilic binder polymer added to the present hydrophilic layer is from 5 to 40 weight %, preferably from 10 to 30 weight % to the total solid contents of the hydrophilic layer When the hydrophilic binder resin as described above is added in such a proportion range, satisfactory on-press developability and film strength can be attained.

To the present hydrophilic layer, a light-to-heat converting agent which generates heat through absorption of infrared ray can be added for the purpose of enhancing the sensitivity. Such a light-to-heat converting agent may be any of light absorption materials having an absorption band in at least a part of the wavelength range of 700 to 1,200 nm, including various pigments, dyes and metallic fine grains.

With respect to the types of such pigments, black pigments, brown pigments, red pigments, violet pigments, blue pigments, green pigments, fluorescent pigments, metallic powder pigments and polymer-bonded dyes can be exemplified. Examples of usable pigments include insoluble azo pigments, azo lake pigments, condensed azo pigments, chelate azo pigments, phthalocyanine pigments, anthraquinone pigments, perylene and periquinone pigments, thioindigo pigments, quinacridone pigments, dioxazine pigments, isoindolinone pigments, quinophthalone pigments, lake pigments, azine pigments, nitroso pigments, nitro pigments, natural pigments, fluorescent pigments, inorganic pigments and carbon black.

These pigments may be used without surface treatment, or they may undergo surface treatment before use. Suitable examples of a method of treating the pigment surface include a method of coating the pigment surface with a hydrophilic resin or an oleophilic resin, a method of attaching a surfactant to the pigment surface and a method of binding a reactive substance (such as silica sol, alumina sol, silane coupling agents, epoxy compounds and isocyanate compounds) to the pigment surface. These surface treatment methods are described in *Kinzoku Sekken no Seisitsu to Oyo* (*Properties and Applications of Metal Soap*), Saiwai Shobo Co., Ltd., *Insatsu Ink Gijutsu* (*Printing Ink techniques*), published by CMC Publishing Co., Ltd. (1984), and *Saishin Ganryo Oyo Gijutsu* (*Latest Pigment Application Techniquies*), published by CMC Publishing Co., Ltd. (1986). Of the pigments described above, pigments capable of absorbing infrared or near infrared ray are preferred in particular since they can impart suitability for utilization of infrared ray laser to the printing plate precursor. As a pigment capable of absorbing infrared ray, carbon black is used to greater advantage.

The suitable grain size of pigment is from 0.01 to 1 μm, preferably from 0.01 to 0.5 μm.

Dyes usable as a light-to-heat converting agent include commercially available dyes and known dyes as described in literature (e.g., *Senryou Binran* (*Handbook of Dyes*), compiled by Yuki Gosei Kagaku Kyokai (1970), *Kagaku Kogyo*

(*Chemical Industry*), entitled "Near Infrared ray Absorbing Dyes", May issue, pp. 45–51 (1986), and 90 *Nendai Kinousei Shikiso no Kaihatsu to Shijo Doukou* (*Development and Market Trends of Functional dyes in* 1990*s*), chapter 2, section 3, CMC Publishing Co., Ltd. (1990)) and patents.

Examples of dyes which can be used suitably include infrared ray absorbing dyes, such as azo dyes, metal complex azo dyes, pyrazolone azo dyes, anthraquinone dyes, phthalocyanine dyes, carbonium dyes, quinoneimine dyes, polymethine dyes and cyanine dyes.

Further, examples of infrared ray absorbing dyes used advantageously, include the cyanine dyes as disclosed in JP-A-58-125246, JP-A-59-84356 and JP-A-60-78787, the methine dyes as disclosed in JP-A-58-173696, JP-A-58-181690 and JP-A-58-194595, the naphthoquinone dyes as disclosed in JP-A-58-112793, JP-A-58-224793, JP-A-59-48187, JP-A-59-73996, JP-A-60-52940 and JP-A-60-63744, the squarylium dyes as disclosed in JP-A-58-112792, the cyanine dyes disclosed in British Patent 434,875, the dyes disclosed in U.S. Pat. No. 4,756,993, the cyanine dyes disclosed in U.S. Pat. No. 4,973,572, and the phthalocyanine dyes disclosed in JP-A-11-235883.

In addition, the near infrared ray absorption sensitizers disclosed in U.S. Pat. No. 5,156,938 can be suitably used as dyes. Besides the dyes described above, the substituted arylbenzo(thio)pyrylium salts disclosed in U.S. Pat. No. 3,881,924, the trimethinethiapyrylium salts disclosed in JP-A-57-142645, the pyrylium compounds disclosed in JP-A-58-181051, JP-A-58-220143, JP-A-59-41363, JP-A-59-84248, JP-A-59-84249, JP-A-59-146063 and JP-A-59-146061, the cyanine dyes disclosed in JP-A-59-216146, the pentamethine-thiopyrylium salts disclosed in U.S. Pat. No. 4,283,475, the pyrylium compounds disclosed in JP-B-5-13514 and JP-B-5-19702 , and Epolite III-178, Epolite III-130 and Epolite III-125 (produced by Epoline Co., Ltd.) can be favorably used.

Some examples of the above-described infrared ray absorbing dyes are illustrated below:

(IR-1)

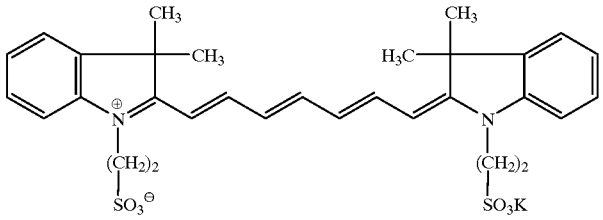

(IR-2)

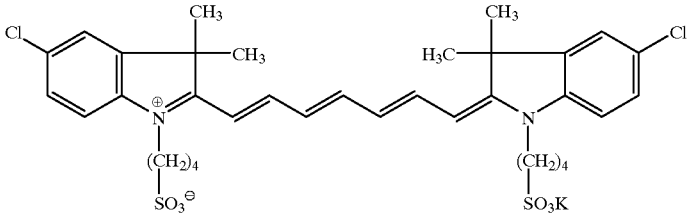

(IR-3)

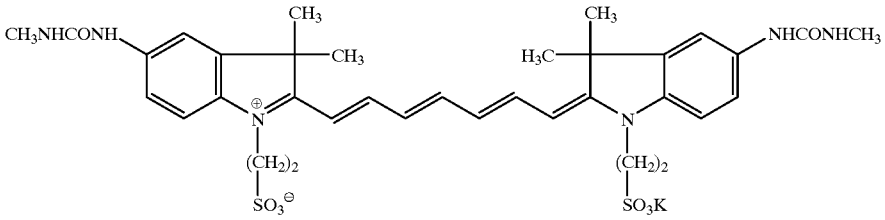

(IR-4)

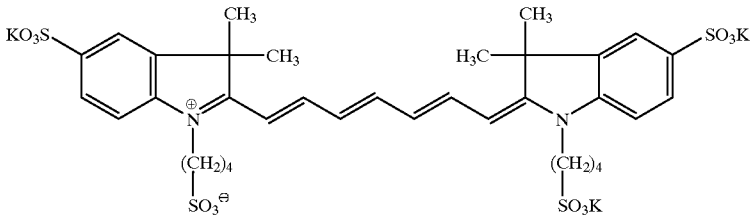

-continued
(IR-5)
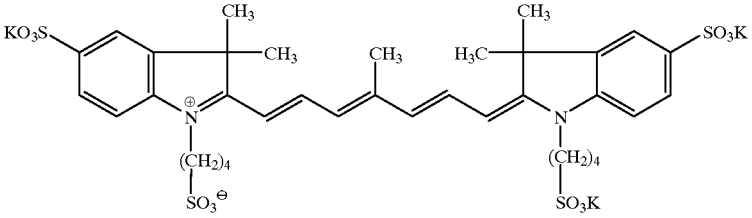
(IR-6)
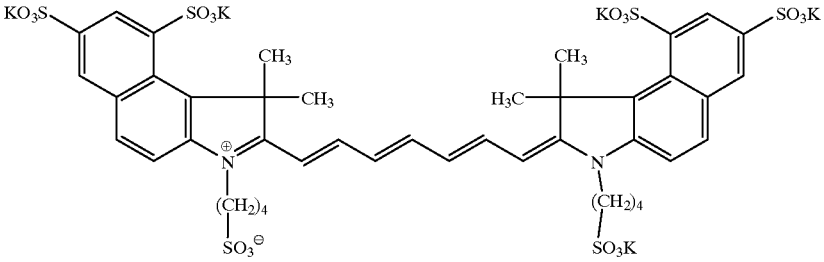
(IR-7)
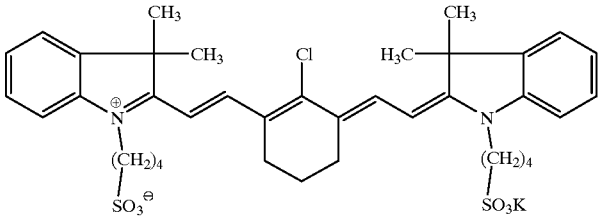
(IR-8)
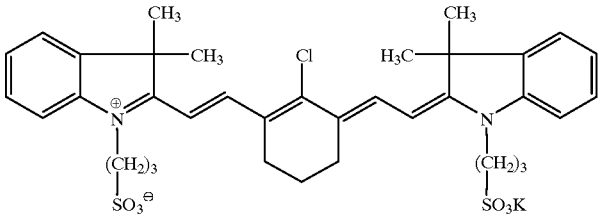
(IR-9)
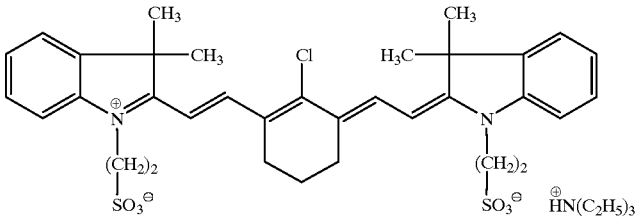
(IR-10)
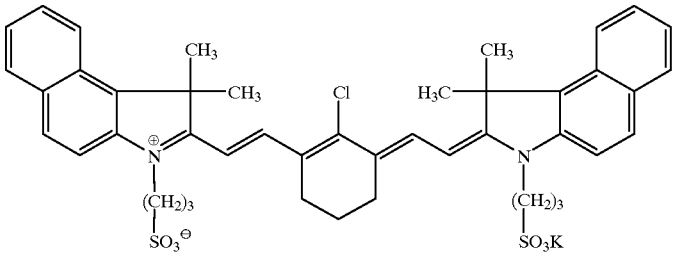

-continued
(IR-11)
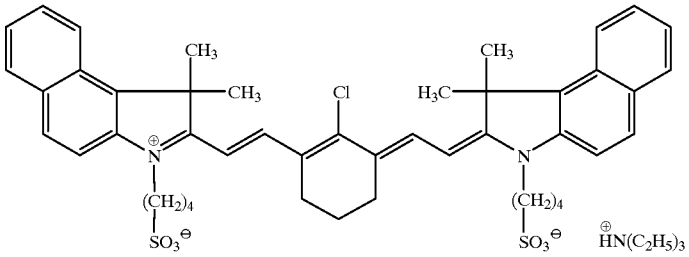
The light-to-heat conversion agent added to hydrophobic compounds, such as polymer fine particles or microcapsules, in the present hydrophilic layer may be infrared ray absorbing dyes as described above, but more suitable dyes therefor are oleophilic dyes. As examples of dyes preferred in particular, the following dyes can be given:
(IR-21)
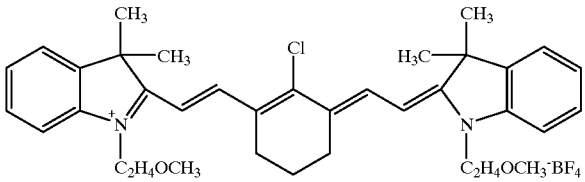
(IR-22)
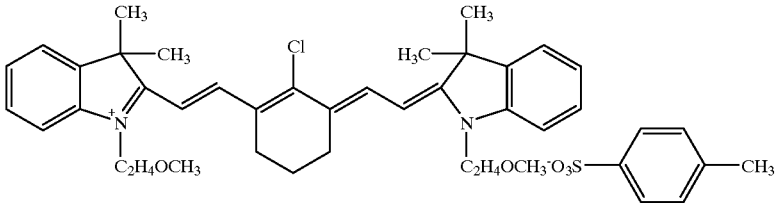
(IR-23)
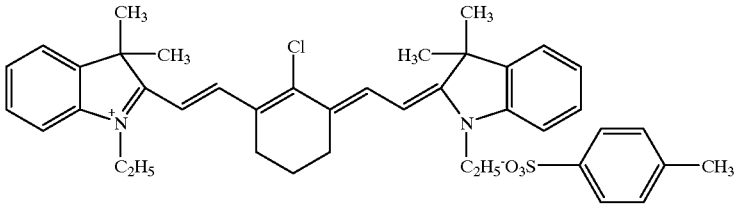
(IR-24)
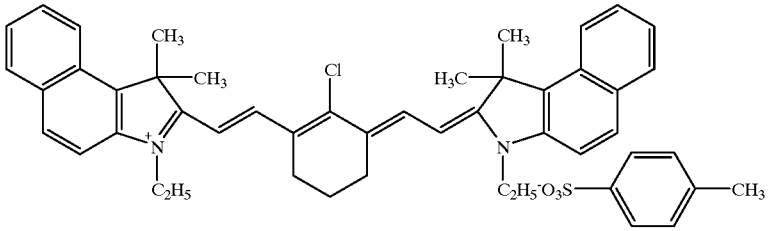
(IR-25)
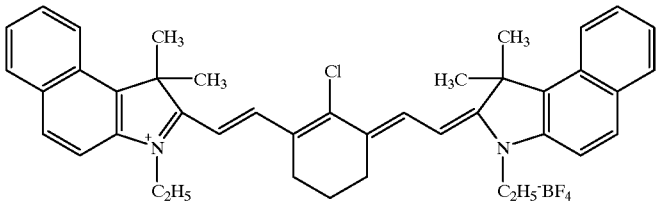

-continued (IR-26)

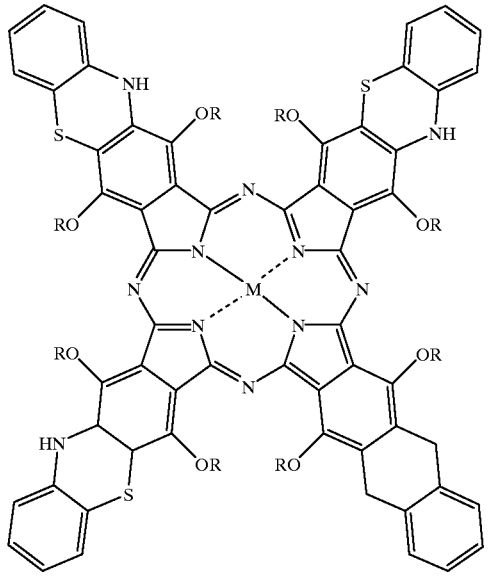

M = VO, R = i-$C_5H_{11}$ (IR-27)

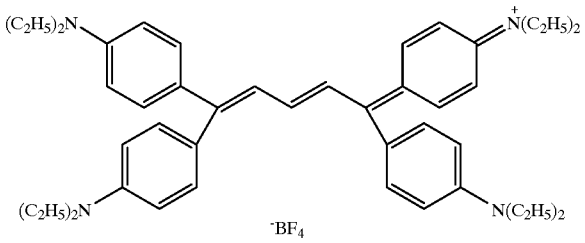

The organic light-to-heat converting agents as described above can be added in a proportion of 30 weight % or less, preferably from 5 to 25 weight %, particularly preferably from 7 to 20 weight %, to the hydrophilic layer.

The light-to-heat converting agents used in the present hydrophilic layer may be metallic fine grains as well. Many kinds of metallic fine grains have light-to-heat converting properties, and besides, they are self-exothermic. Suitable examples of metalli c fine grains include fine grains of a simple metallic substance, such as Si, Al, Ti, V, Cr, Mn, Fe, Co, Ni, Cu, Zn, Y, Zr, Mo, Ag, Au, Pt, Pd, Rh, In, Sn, W, Te, Pb, Ge, Re or Sb, fine grains of an alloy of two or more metallic elements selected from the above-described ones, fine grains of an oxide of one or more metallic elements selected from the above-described ones and fine grains of a sulfide of one or more metallic elements selected from the above-described ones.

As to the metals constituting the foregoing metallic fine grains, metals which tend to coalesce by the action of heat at the time when they are irradiated to light, have a melting point of about 1,000° C. or below and absorb light in the infrared, visible or ultraviolet region, such as Re, Sb, Te, Au, Ag, Cu, Ge, Pb and Sn, are preferable.

Especially preferred metals are metals having a relatively low melting point and showing relatively high absorbance in the infrared region, with examples including Ag, Au, Cu, Sb, Ge and Pb. Of these metals, Ag, Au and Cu are advantageous in particular.

Further, the metallic fine grains may be constituted of two or more different types of light-to-heat converting materials. For instance, fine grains of a metal having a low melting point, such as Re, Sb, Te, Au, Ag, Cu, Ge, Pb or Sn, and fine grains of a self-exothermic metal, such as Ti, Cr, Fe, Co, Ni, W or Ge, can be used as a mixture. In addition, it is appropriate to use fine fragments of a metal species which can show especially strong absorption when reduced to fine fragments, such as Ag, Pt or Pd, in combination with other metal fine fragments.

The suitable size of those grains is not greater than 10 $\mu$m, preferably from 0.003 to 5 $\mu$m, particularly preferably from 0.01 to 3 $\mu$m. The finer the grains are in size, the lower solidification temperature they have, so the higher the photosensitivity in heat mode becomes. Therefore, it is advantageous to make the grains finer in size. However, the grains finer in size are difficult to disperse. Conversely, the grains having sizes greater than 10 $\mu$m causes deterioration in resolution of printed matter.

The metallic fine grains as a light-to-heat converting agent are added in a proportion of at least 10 weight %, preferably at least 20 weight %, particularly preferably at least 30 weight %, to the total solid contents of the hydrophilic layer. When the proportion of metal fine grains becomes lower than 10 weight %, the sensitivity is lowered.

The light-to-heat converting agents as described above may be incorporated in the subbing layer as an adjacent layer of the hydrophilic layer, or a water-soluble overcoat layer described below. The incorporation of a light-to-heat converting agent in at least one among the hydrophilic layer, the subbing layer and the overcoat layer can increase the infrared ray absorption efficiency, and thereby improve the sensitivity.

The present hydrophilic layer may contain a cross-linking agent, if needed. Suitable examples of such a cross-linking agent include low molecular compounds having methylol groups, melamine-formaldehyde resin, hydantoin-formaldehyde resin, thiourea-formaldehyde resin and benzoguanamine-formaldehyde resin.

To the present hydrophilic layer, various compounds other than the above-described compounds may be added, if desired. For instance, dyes having strong absorption in the visible region can be used as a coloring agent for easily making a distinction between image and non-image areas after image formation. Examples of such dyes include Oil Yellow #101, Oil Yellow #103, Oil Pink #312, Oil Green BG, Oil Blue BOS, Oil Blue #603, Oil Black BY, Oil Black BS, Oil Black T-505 (products of Orient Chemical Industry Co., Ltd.), Victoria Pure Blue, Crystal Violet (C.I.42555), Methyl Violet (C.I.42535), Ethyl Violet, Rhodamine B (C.I.145170B), Malachite Green (C.I.42000), Methylene Blue (C.I.52015), and the dyes disclosed in JP-A-62-293247. Further, pigments such as phthalocyanine pigments, azo pigments and titanium dioxide can be used appropriately for the above purpose. These coloring agents are added in a proportion of 0.01 to 10 weight % to the total solid contents in a coating composition for the hydrophilic layer.

To the present hydrophilic layer, plasticizers can be added, if needed, for the purpose of imparting pliability to the coating film. Examples of such plasticizers include polyethylene glycol, tributyl citrate, diethyl phthalate, dibutyl phthalate, dihexyl phthalate, dioctyl phthalate, tricresyl phosphate, tributyl phosphate, trioctyl phosphate and tetrahydrofurfuryl oleate.

In forming the present hydrophilic layer, a coating composition is prepared by dissolving or dispersing necessary ingredients as described above in a solvent, and coated. Examples of a solvent usable therein include ethylene dichloride, cyclohexanone, methyl ethyl ketone, methanol, ethanol, propanol, ethylene glycol monomethyl ether, 1-methoxy-2-propanol, 2-methoxyethyl acetate, 1-methoxy-2-propyl acetate, dimethoxyethane, methyl lactate, ethyl lactate, N,N-dimethylacetamide, N,N-dimethylformamide, tetramethylurea, N-methylpyrrolidone, dimethyl sulfoxide, sulforan, γ-butyrolactone, toluene and water. However, these examples should not be construed as limiting solvents usable for the forgoing purpose. Those solvents may be used alone or as a mixture of two or more thereof. The suitable solids concentration of the coating composition is from 1 to 50 weight %.

The suitable coverage (on a solids basis) of the hydrophilic layer formed on the support by coating and drying the coating composition, though depends on the end use purpose, is generally from 0.5 to 5.0 g/m$^2$. When the coverage is below this range, the film properties of the hydrophilic layer to fulfill an image-recording function are degraded although the apparent sensitivity is increased. For forming the present hydrophilic layer, various coating methods can be used, with examples including bar coater coating, spin coating, spray coating, curtain coating, dip coating, air knife coating, blade coating and roll coating methods.

To the coating composition for forming the present hydrophilic layer, surfactants, e.g., the fluorine-containing surfactants as disclosed in JP-A-62-170950, can be added for improving coating properties. The suitable proportion of such surfactants to the total solid contents of the hydrophilic layer is from 0.01 to 1 weight %, preferably from 0.05 to 0.5 weight %. In order to prevent the contamination of the hydrophilic layer surface with oleophilic materials, the lithographic printing plate precursor of the present invention may have on the hydrophilic layer a water-soluble overcoat layer. The water-soluble overcoat layer used in the present invention can be removed easily at the time of printing, and comprises at least one resin selected from water-soluble high molecular compounds. The water-soluble high molecular compounds usable therein are compounds capable of forming films when coated and dried, with examples including polyvinyl acetate (having a hydrolysis factor of at least 65%),polyacrylic acid and alkali metal or amine salts thereof, acrylic acid copolymers and alkali metal or amine salts thereof, polymethacrylic acid and alkali metal or amine salts thereof, methacrylic acid copolymers and alkali metal or amine salts thereof, polyacrylamide and acrylamide copolymers, polyhydroxyethyl acrylate, polyvinyl pyrrolidone and vinyl pyrrolidone copolymers, polyvinyl methyl ether, poly-vinyl methyl ether-maleic anhydride copolymer, poly-2-acrylamide-2-methyl-1-propanesulfonic acid and alkali metal or amine salts thereof, poly-2-acrylamide-2-methyl-1-propanesulfonic acid copolymers and alkali metal or amine salts thereof, gum arabic, cellulose derivatives (such as carboxymethyl cellulose, carboxyethyl cellulose and methyl cellulose) and denatured products thereof, white dextrin, pullulan and enzyme-decomposed etherified dextrin. These resins may be used as a mixture of two or more thereof, if desired.

To the overcoat layer, the water-soluble or water-dispersible light-to-heat converting agents as described above may further be added. When the overcoat layer is formed using an aqueous coating solution, nonionic surfactants, such as polyoxyethylene nonyl phenyl ether and polyoxyethylene dodecyl ether, can be added to the coating solution for the purpose of ensuring the uniformity in the layer coated.

The suitable coverage (on a solids basis) of the overcoat layer is from 0.1 to 2.0 g/m$^2$. When the overcoat layer has its coverage within this range, it can effectively prevent the hydrophilic layer surface from being smudged with oleophilic substances, e.g., fingerprints left thereon without impairing the on-press developability.

The lithographic printing plate precursor of the present invention can form images by the action of heat. More specifically, direct imagewise recording, e.g., with a thermal head, scanning exposure using, e.g., an infrared ray laser, high-illuminance flash exposure using, e.g., a xenon discharge lamp, or an infrared ray lamp exposure can be employed for the image formation. Of these exposure means, solid-state high-output infrared ray laser capable of emitting beams having their wavelengths in the range of 700 to 1,200 nm, such as semiconductor laser and YAG laser, are preferred over the others.

The lithographic printing plate precursor of the present invention having received imagewise exposure is mounted in a printing machine without undergoing further processing, and made available for printing in accordance with a usual procedure using ink and a fountain solution.

On the other hand, as disclosed in Japanese Patent 2,938,398, it is also possible that the lithographic printing plate precursor is mounted on the cylinder of a printing machine, exposed by means of a laser device installed in the printing machine, and then subjected to on-press development by applying thereto a fountain solution and/or ink.

In addition, the present lithographic printing plate precursor having received imagewise exposure may be developed with water or an appropriate aqueous solution as a developer, and then subjected to printing operations.

EXAMPLE

Now, the present invention will be illustrated in more detail by reference to the following examples, but these examples should not be construed as limiting the present invention in any way.

Synthesis Example of Finely Divided Polymer Having Reactive Groups

In a reaction vessel, 7.5 g of allyl methacrylate, 7.5 g of butyl methacrylate and 200 ml of an aqueous solution of polyoxyethylene nonyl phenyl ether (concentration: $9.84\times10^{-3}$ mole/l) were placed, and mixed together. And the air inside the vessel was replaced by nitrogen gas with stirring the mixture at 250 r.p.m. The resulting solution was controlled so as to have a temperature of 25° C., and then 10 ml of an aqueous solution of ammonium salt of cerium (IV) (concentration: $0.984\times10^{-3}$ mole/l) was added thereto. At this time, an aqueous solution of ammonium nitrate (concentration: $58.8\times10^{-3}$ mole/l) was also added so that the reaction solution was adjusted to pH 1.3–1.4. Thereafter, the stirring was continued for 8 hours. The thus obtained solution had a solids concentration of 9.5% and an average particle size of 0.4 $\mu$m.

Preparation Example 1 of Microcapsules

An oil-phase component was prepared by dissolving 40 g of xylene diisocyanate, 10 g of trimethylolpropane diacrylate, 10 g of a copolymer of allyl methacrylate and butyl methacrylate (7/3 by mole) and 0.1 g of Pionin A41C (produced by Takemoto Yshi) in 60 g of ethyl acetate. As a water-phase component, 120 g of a 4% aqueous solution of polyvinyl alcohol, PVA 205 (trade name, a product of Kararay Co., Ltd.) was prepared. An emulsion was made by mixing the foregoing oil-phase and water-phase components by means of a homogenizer rotating at 10,000 r.p.m. The emulsion thus made was admixed with 40 g of water, stirred for 30 minutes at room temperature, and further stirred for 3 hours at 40° C. The thus prepared microcapsule solution had a solids concentration of 20% and an average microcapsule size of 0.5 $\mu$m.

Preparation Example 2 of Microcapsules

An oily component was prepared by homogeneously dissolving 1.26 g of Coronate L (constituted of 1:3 by mole adduct of trimethylolpropane and 2,4-tolylenedisocyanate and 25 weight % of ethyl acetate, a product of Nippon Polyurethane Industry Co., Ltd.) in 7.2 g of glycidyl methacrylate. Then, a water-phase component was prepared by mixing 2 g of propylene glycol ester of alginic acid (having a number average molecular weight of $2\times10^5$, Duckloid LF, trade name, a product of Kibun Food Chemiphar Co., Ltd.) and 0.8 g of polyethylene glycol (PEG 400, produced by Sanyo Chemical Industries Co., Ltd.) in 120 g of purified water. Subsequently, the oily component and the water-phase component were mixed and emulsified at room temperature by the use of a homogenizer rotating at 6,000 r.p.m., and allowed to react with each other for 3 hours at 60° C. Thus, microcapsules having an average size of 1.8 $\mu$m were obtained.

Preparation Example 3 of Microcapsules

In a container were placed 10 g of a solid matter obtained by removing the solvent from Coronate L, 8 g of ethyl alcohol, 2 g of purified water and 30 g of a 5% aqueous solution of polyacrylamide. The resulting container was shaken using a paint shaker for 1 hour at room temperature. Thus, isocyanate microcapsules the surface of which was blocked were prepared. The average size of the dispersed primary particles was 1.0 $\mu$m.

Preparation Example 4 of Microcapsules

Microcapsules were prepared in the same manner as in Preparation Example 2, except that 0.3 g of a light-to-heat converting agent (Dye IR-24 illustrated in this specification) was added to the oily component.

Preparation Examples I-1 and I-2 of Substrate

A 0.3 mm-thick aluminum sheet (material quality: JIS A 1050) was grained using a nylon brush No. 8 and an aqueous suspension of 800-mesh purmice stone, and washed thoroughly with water. This grained sheet was etched by 60-second immersion in a 10% aqueous solution of sodium hydroxide kept at 70° C., washed with running water, rinsed with 20% $HNO_3$ for neutralization, and further washed with water. Then, the thus etched sheet underwent electrolytic graining treatment for roughening the surface thereof, wherein a 1% aqueous solution of nitric acid was used as an electrolyte and an alternating current of sine-wave form was applied under the condition of $V_a$=12.7 V so that the quantity of electricity at the anode was 300 Coulomb/dm$^2$. The surface roughness measurement showed that the thus treated aluminum sheet had a center-line surface roughness of 0.45 $\mu$m, expressed in terms of Ra. Successively thereto, the aluminum sheet was desmutted by 2-minute immersion in a 30% aqueous solution of $H_2SO_4$ kept at 55° C., and further anodized by direct-current electrolysis in a 15% aqueous solution of $H_2SO_4$ for 45 seconds under the condition of a current density of 5 A/dm$^2$, thereby forming an anodic oxidation layer. The substrate having the anodic oxidation layer thus formed was referred to as Substrate (0).

Then, the anodic oxidation layer thus formed was subjected to widening treatment for micropores thereof. In one way of treatment, Substrate (0) was immersed for 1 minute in a 60° C. sulfuric acid solution having a concentration of 50 g/l, then washed with water, and further dried. The Substrate (0) thus pore-widened with sulfuric acid was referred to as Substrate (A). In the other way of treatment, Substrate (0) was washed with water, immersed for 10 seconds in a 40° C. aqueous solution containing 0.1 mole of sodium carbonate and 0.1 mole of sodium hydrogen carbonate and being adjusted to pH 12 with sodium hydroxide, thereby causing an increase in pore diameter, then washed with water, and further dried. Substrate (0) thus pore-widened with alkali was referred to as Substrate (B).

These Substrates (A) and (B) were each subjected to pore-sealing treatment for 12 seconds in a 100° C. chamber saturated with steam under 1 atmospheric pressure. Further, they were treated with a 70° C. aqueous solution containing sodium silicate in a concentration of 2.0 weight % (till the amount of silicate deposition reached 10 mg/m$^2$ based on silicon), washed with water, and then dried, thereby preparing Substrates (IA) and (IB) respectively.

The thus prepared Substrate (IA) had an average micropore diameter (abbreviated as "average pore diameter", "average pore size, or "pore diameter" hereinafter) of 9 nm, and the thus prepared Substrate (IB) had an average pore diameter of 11 nm. The average pore diameter was determined by observing micropores using a Hitachi scanning electron microscope Model S-900 under a condition that the acceleration voltage was 12 kV and no evaporating operation was performed.

Preparation Examples II-1 to II-6 of Substrate

Substrate (A), or the substrate pore-widened with sulfuric acid in Preparation Example I, was immersed in each of the aqueous solutions of hydrophilic compounds shown in Table 1 under conditions corresponding thereto respectively, which are also shown in Table 1, then washed with water, and further dried. Thus, Substrates (IIA1) to (IIA6) were obtained.

TABLE 1

Conditions for Water Receptivity-imparting Treatment in Preparation Examples II-1 to II-6 of Substrate

| Preparation Example | Species and Concentration (weight %) of Hydrophilic Compound in Aqueous Solution for Imparting Water Receptivity | Temperature and Time of Treatment | Support obtained |
|---|---|---|---|
| II-1 | Sodium silicate (2.5%) | 70° C., 12 sec | (IIA1) |
| II-2 | Potassium zirconium fluoride (1.5%) | 60° C., 60 sec | (IIA2) |
| II-3 | $NaH_2PO_4$/NaF (10%/0.1%) | 70° C., 30 sec | (IIA3) |
| II-4 | Polyvinylphosphonic acid (0.5%) | 60° C., 10 sec | (IIA4) |
| II-5 | Sodium ligninsulfonate (0.1%) pH 5.5 | 80° C., 60 sec | (IIB5) |
| II-6 | Saponin (1%) pH 5.5 | 40° C., 30 sec | (IIA6) |

Preparation Examples II-7 to II-12 of Substrate

After washing Substrate (0) prepared in Preparation Example I with water, the substrate was immersed for 10 seconds in a 60° C. aqueous solution containing 0.1 M of sodium carbonate and 0.1 M of sodium hydrogen carbonate and being adjusted to pH 13 with sodium hydroxide, thereby causing an increase in pore diameter, then washed with water, and further dried, thereby preparing a pore-widened Substrate (IIB). Next, Substrate (IIB) was immersed in each of the aqueous solutions of hydrophilic compounds shown in Table 2 under conditions corresponding thereto respectively, which are also shown in Table 2, then washed with water, and further dried. Thus, Substrates (IIB1) to (IIB6) were obtained.

TABLE 2

Conditions for Water Receptivity-imparting Treatment in Preparation Examples II-7 to II-12 of Substrate

| Preparation Example | Species and Concentration (weight %) of Hydrophilic Compound in Aqueous Solution for Imparting Water Receptivity | Temperature and Time of Treatment | Support obtained |
|---|---|---|---|
| II-7 | Sodium silicate (2.5%) | 70° C., 12 sec | (IIB1) |
| II-8 | Potassium zirconium fluoride (1.5%) | 60° C., 60 sec | (IIB2) |
| II-9 | $NaH_2PO_4$/NaF (10%/0.1%) | 70° C., 30 sec | (IIB3) |
| II-10 | Polyvinylphosphonic acid (0.5%) | 60° C., 10 sec | (IIB4) |
| II-11 | Sodium ligninsulfonate (0.1%) pH 5.5 | 80° C., 60 sec | (IIB5) |
| II-12 | Saponin (1%) pH 5.5 | 40° C., 30 sec | (IIB6) |

Preparation Examples III-1 to III-5 of Substrate having Subbing Layer

Substrates (IIIA1) to (IIIA5) having their respective subbing layers were prepared by coating the subbing solutions shown in Table 3 on the substrates to be combined therewith respectively, which are also shown in Table 3, and then drying under heating (for 2 minutes at 100° C.). Specifically, Substrate (A) prepared in Preparation Example I, which had received pore-widening treatment in the aqueous solution of sulfuric acid, and Substrate (IIA1) prepared by immersing Substrate (A) in the aqueous solution of sodium silicate were employed as the substrates to be coated with subbing solutions. The compositions of subbing solutions (1) to (5) used therein are each described below. And the dry coverage of each subbing layer is shown in Table 3.

TABLE 3

Preparation Examples III-1 to III-5 of Substrate having Subbing Layer

| Preparation Example | Original Substrate | Kind of Subbing Solution | Dry Coverage ($mg/m^2$) | Support having Subbing Layer |
|---|---|---|---|---|
| III-1 | (IIA1) | 1 | 10 | (IIIA1) |
| III-2 | (IIA1) | 2 | 10 | (IIIA2) |
| III-3 | (IIA1) | 3 | 20 | (IIIA3) |
| III-4 | (A) | 4 | 10 | (IIIA4) |
| III-5 | (A) | 5 | 15 | (IIIA5) |

| | |
|---|---|
| Composition of Subbing Solution (1) | |
| Carboxymethyl cellulose (Celogen WS-A, produced by Dai-ichi Kogyo Seiyaku Co., Ltd.) | 4 g |
| Magnesium acetate tetrahydrate | 4 g |
| Distilled water | 1,000 g |
| Composition of Subbing Solution (2) | |
| Carboxymethyl cellulose (Celogen 6A, produced by Dai-ichi Kogyo Seiyaku Co., Ltd.) | 4 g |
| Nickel acetate tetrahydrate | 4 g |
| Distilled water | 1,000 g |
| Composition of Subbing Solution (3) | |
| Polyacrylic acid (having weight average molecular weight of $2.5 \times 10^4$, produced by Wako Pure Chemical Industries, Ltd.) | 4 g |
| Manganese acetate tetrahydrate | 2.5 g |
| Distilled water | 1,000 g |
| Composition of Subbing Solution (4) | |
| Carboxymethyl cellulose (Celogen WS-C, produced by Dai-ichi Kogyo Seiyaku Co., Ltd.) | 4 g |
| Calcium acetate monohydrate | 4 g |
| Distilled water | 800 g |
| Methanol | 200 g |
| Composition of Subbing Solution (5) | |
| Acrylamide/methacrylic acid copolymer (having polymerization ratio of 3/1 by mole and weight average molecular weight of $1.0 \times 10^5$) | 4 g |
| Nickel acetate tetrahydrate | 4 g |
| Distilled water | 1,000 g |

Preparation Example 1 of Comparative Substrate

Substrate (0) prepared in Preparation Example I was washed with water, and dried. The thus obtained substrate was referred to as a comparative Substrate (i) The micropores of the comparative Substrate (i) had an average pore diameter of 4 nm.

Preparation Example 2 of Comparative Substrate

Comparative Substrate (i) was immersed for 20 seconds in a 60° C. aqueous solution containing 0.1 mole of sodium carbonate and 0.1 mole of sodium hydrogen carbonate and being adjusted to pH 13 with sodium hydroxide, and thereby the pore diameter thereof was widened. Then, it was washed with water and dried. The thus treated substrate was referred to as comparative Substrate (ii). The micropores of the comparative Substrate (ii) had an average pore diameter of 42 nm.

Examples I-1 to I-2

Comparative Examples I-1 to I-2

A coating Composition 1 for forming a hydrophilic layer was prepared in the following manner, coated at a coverage of 30 g/m$^2$ (on a liquid basis) on each of Substrates (IA) to (IB) and comparative Substrates (i) to (ii) prepared in the foregoing Preparation Examples, and then dried at 100° C. for 60 seconds. Thus, the hydrophilic layer having a dry coverage of 1.5 g/m$^2$ was provided.

(Preparation of Coating Composition 1 for Hydrophilic Layer)

To 8 g of a 20 weight % dispersion prepared by dispersing polystyrene (Tg: 100° C., average particle diameter: 90 nm) into demineralized water with the aid of a nonionic surfactant, 0.24 g of polyoxyethylene nonyl phenyl ether and 15.46 g of demineralized water were added successively, and lastly 8 g of a 5 weight % aqueous solution of polyvinyl alcohol, PVA 205 (trade name, a product of Kuraray Co., Ltd) was added with stirring.

On the hydrophilic layer provided on each substrate in the foregoing manner, a coating Composition OC-1 for an overcoat layer, the formula of which is shown below, was coated at a coverage of 20 g/m$^2$ (on a liquid basis), and dried at 100° C. for 60 seconds. Thus, heat-sensitive lithographic printing plate precursors which were each provided with the overcoat layer having a dry coverage of 1.0 g/m$^2$ were prepared.

| (Coating Composition OC-1 for Overcoat Layer) | |
|---|---|
| Polyacrylic acid (weight average molecular weight: 2.5 × 10$^4$) | 1 g |
| 20 weight % Ethanol dispersion of carbon black stabilized with nonionic surfactant | 2.5 g |
| Methanol | 26.5 g |

Each of the thus prepared lithographic printing plate precursors was installed in a 40W Trend Setter made by CREO Co. (a plate setter equipped with a 40W semiconductor laser emitting light of 830 nm), and thereto the laser energy of 200 mJ/cm$^2$ was applied. The printing plate precursor thus irradiated with laser was mounted in a Harris Aurelia printing machine without any further processing, and subjected to printing operations using ink and a fountain solution constituted of an etch solution and a 10 volume % aqueous isopropyl alcohol solution. The printing results obtained and measured values of average pore diameters of the substrates used are shown in Table 4.

TABLE 4

| | Substrate | | Impression capacity (number of | Scumming |
|---|---|---|---|---|
| | Type | Average pore diameter (nm) | clearly printed matters) | resistance (ink eliminability) |
| Example I-1 | (IA) | 9 | 20,000 | good |
| Example I-2 | (IB) | 11 | 25,000 | good |
| Comparative Example I-1 | (i) | 4 | 3,000 | good |
| Comparative Example I-2 | (ii) | 42 | 20,000 | poor |

As can be seen from Table 4, the heat-sensitive lithographic printing plate precursors according to the present invention ensured high press life and high scumming resistance in the process of printing.

Examples I-3 to I-4

Comparative Examples I-3 to I-4

Heat-sensitive lithographic printing plate precursors were prepared in the same manners as in Examples I-1 to I-2 and Comparative Examples I-1 to I-2 respectively, except that a coating Composition 2 prepared by substituting finely divided polymethyl methacrylate (Tg: 90° C., average particle diameter: 80 nm) for the finely divided polystyrene in the coating Composition 1 was used in place of the coating Composition 1 for forming a hydrophilic layer.

Next, each of the thus prepared printing plate precursors was subjected to the same exposure and printing operations as in Example I-1. The results obtained are shown in Table 5.

TABLE 5

| | Substrate | | Impression capacity (number of | Scumming |
|---|---|---|---|---|
| | Type | Average pore diameter (nm) | clearly printed matters) | resistance (ink eliminability) |
| Example I-3 | (IA) | 9 | 18,000 | good |
| Example I-4 | (IB) | 11 | 20,000 | good |
| Comparative Example I-3 | (i) | 4 | 2,500 | good |
| Comparative Example I-4 | (ii) | 42 | 18,000 | poor |

The above results also demonstrate that the heat-sensitive lithographic printing plate precursors according to the present invention ensured satisfactorily high press life and scumming resistance in the process of printing.

Examples I-5 and I-6

Heat-sensitive lithographic printing plate precursors were prepared in the same manner as in Example I-1, except that the substrate used was Substrate (IA) in Example I-5, that was Substrate (IB) in Example I-6, and the coating composition used for forming each hydrophilic layer was prepared by adding 0.4 g of a light-to-heat converting agent (Dye IR-11 illustrated in this specification) to the coating Composition 1 for the hydrophilic layer.

Then, these printing plate precursors were each subjected to the same exposure and printing operations as in Example I-1. From each of these printing plate precursors, 15,000 to 20,000 sheets of scumming-free good printed matter were obtained.

Examples I-7 to I-8

Comparative Examples I-5 to I-6

Heat-sensitive lithographic printing plate precursors were prepared by coating a coating Composition 3 for a hydrophilic layer, the formula of which is shown below, so as to have a dry coverage of 0.5 g/m$^2$ on different aluminum substrates respectively (shown in Table 6), and then drying the coating (for 60 seconds by means of a 100° C. oven)

| (Coating Composition 3 for Hydrophilic layer) | |
|---|---|
| Finely divided polymer having thermally reactive functional groups (described in Synthesis Example) | 5 g (on solids basis) |

-continued

| (Coating Composition 3 for Hydrophilic layer) | |
|---|---|
| Polyhydroxyethyl acrylate (weight average molecular weight: 25,000) | 0.5 g |
| Light-to-heat converting agent (Dye IR-11 illustrated in this specification) | 0.3 g |
| Water | 100 g |

The thus prepared printing plate precursors having on-press developability were each exposed using a Trend Setter, 3244VFS (trade name, made by CREO CO.), equipped with a 40W water-cooled infrared ray semiconductor laser device, under conditions that the output was 9W, the external drum revolving speed was 210 r.p.m. the energy at the plate surface was 100 mJ/cm$^2$ and the resolution was 2400 dpi., and then mounted on the cylinder of a printing machine, SOR-M (made by Heidelberg A.G.) without any further processing. And printing was performed by feeding thereto a fountain solution, ink and paper sheets successively. Therein, on-press development of every printing plate precursor was achieved without any troubles, and it was possible to perform the printing from each of the printing plates having received the foregoing processing. The printing results obtained are shown in Table 6.

TABLE 6

| | Substrate | | Impression capacity (number of clearly printed matters) | Scumming resistance (ink eliminability) |
|---|---|---|---|---|
| | Type | Average pore diameter (nm) | | |
| Example I-7 | (IA) | 9 | 15,000 | good |
| Example I-8 | (IB) | 11 | 20,000 | good |
| Comparative Example I-5 | (i) | 4 | 1,000 | good |
| Comparative Example I-6 | (ii) | 42 | 25,000 | poor |

The results shown above reveal that the application of a hydrophilic layer comprising a finely divided polymer having thermally reactive functional groups to the present substrates having improved adhesion to the hydrophilic layer enabled lithographic printing plate precursors to have good on-press developability and ensure scumming resistance and press life in the process of printing.

Examples I-9 to I-10

Comparative Examples I-7 to I-8

Heat-sensitive lithographic printing plate precursors were prepared by using a coating Composition 4 for a hydrophilic layer comprising the microcapsules formed in Preparation Example I-1 of Microcapsules, the formula of which is shown below, in combination with different aluminum substrates respectively (shown in Table 7) The hydrophilic layer coated was dried for 60 seconds by means of a 100° C. oven, and had a dry coverage of 0.7 g/m$^2$.

| (Coating Composition 4 for Hydrophilic layer) | |
|---|---|
| Microcapsules of Preparation Example I-1 | 5 g (on solids basis) |
| Trimethylolpropane triacrylate | 3 g |
| Infrared ray absorbing dye (Dye IR-11 illustrated in this specification) | 0.3 g |
| Water | 60 g |
| 1-Methoxy-2-propanol | 40 g |

The lithographic printing plate precursors thus prepared were each exposed using a multichannel laser head-mounted Luxel T-9000CTP (made by Fuji Photo Film Co., Ltd.) under conditions that the output per beam was 250 mW, the external drum revolving speed was 800 r.p.m. and the resolution was 2400 dpi. For printing from each of the thus made printing plates, the same printing conditions as in Example I-1 was adopted. The printing results obtained are shown in Table 7.

TABLE 7

| | Substrate | Impression capacity (number of clearly printed matters) | Scumming resistance (ink eliminability) |
|---|---|---|---|
| Example I-9 | (IA) | 15,000 | good |
| Example I-10 | (IB) | 20,000 | good |
| Comparative Example I-7 | (i) | 500 | good |
| Comparative Example I-8 | (ii) | 30,000 | poor |

Examples I-11 to I-16

Hydrophilic layers were formed respectively using combinations of the substrates and the coating compositions shown in Table 8 On each of the thus formed hydrophilic layers, a coating Composition OC-2 for an overcoat layer was coated to prepare a lithographic printing plate precursor. Before coating, each of the coating compositions for hydrophilic layers was thoroughly stirred for 30 minutes at room temperature by the use of a paint shaker. And the coating thereof was carried out using a blade coater, followed by drying. The dry coverage of each hydrophilic layer formed is shown in Table 8. The dry coverage of the overcoat layer formed was about 0.6 g/m$^2$.

| (Coating Composition 5 for Hydrophilic layer) | |
|---|---|
| 10 weight % Aqueous solution of hydrophilic resin (1) | 20.0 g |
| Microcapsules prepared in Preparation Example 2 | 80.0 g |
| 3 weight % Aqueous solution of alginic acid ester | 300 g |

The hydrophilic resin (1) used herein was polyacrylic acid having a number average molecular weight of 80,000 (Julymer AC10MP, trade name, a product of Nippon Junyaku Co., Ltd.), and the alginic acid ester used was propylene glycol ester of alginic acid (Duckloid LF, trade name, a product of Kibun Food Chemipha Co., Ltd.).

| (Coating Composition 6 for Hydrophilic layer) | |
|---|---|
| 15 weight % Aqueous solution of hydrophilic resin (2) | 12 g |
| Microcapsules prepared in Preparation Example 3 (solids concentration: 20%) | 6 g |
| Calcium carbonate | 1 g |
| Water | 19 g |

The hydrophilic resin (2) used herein was a 2-hydroxyethyl methacrylate/acrylamide/acrylic acid (1/4/4 by weight) copolymer having a number average molecular weight of 100,000.

| (Coating Composition 7 for Hydrophilic layer) | |
|---|---|
| 10 weight % Aqueous solution of hydrophilic resin (1) | 20.0 g |
| Microcapsules prepared in Preparation Example 4 | 80.0 g |
| 3 weight % Aqueous solution of alginic acid ester | 300 g |
| (Coating Composition OC-2 for Overcoat Layer) | |
| Polyacrylic acid (weight average molecular weight: $2.5 \times 10^4$) | 1 g |
| Light-to-heat converting agent (Dye IR-11 illustrated in this specification) | 0.2 g |
| Polyoxyethylene nonyl phenyl ether | 0.025 g |
| Water | 19 g |

The thus prepared lithographic printing plate precursors were each exposed and used for printing in the same manners as in Example I-7. The results obtained are shown in Table 8.

TABLE 8

| | Substrate | Coating Composition for Hydrophilic layer | Dry Thickness of Hydrophilic layer | Number of Clearly Printed matters |
|---|---|---|---|---|
| Example I-11 | (IA) | 5 | 3.5 μm | 12,500 |
| Example I-12 | (IB) | 5 | 3.5 μm | 15,000 |
| Example I-13 | (IA) | 6 | 3.0 μm | 15,000 |
| Example I-14 | (IB) | 6 | 3.0 μm | 15,000 |
| Example I-15 | (IA) | 7 | 3.0 μm | 20,000 |
| Example I-16 | (IB) | 7 | 3.0 μm | 20,000 |

Example I-17

On Substrate (IB), a solution constituted of 115 g of a 0.15% aqueous solution of gum arabic and 48 g of methanol was spin-coated at 180 r.p.m. by means of a whirler, and dried for 1 minute at 100° C. to form a subbing layer. On the subbing layer thus formed, the foregoing coating Composition 5 for a hydrophilic layer and coating Composition OC-2 for an overcoat layer were coated to prepare a lithographic printing plate precursor. The printing plate precursor thus prepared was exposed and used for printing in the same manners as in Example I-7. Thus, 15,000 sheets of clearly printed matter was obtained.

Examples II-1 to II-6

Comparative Examples II-1 to II-2

On each of Substrates (IIA1) to (IIA6) prepared in Preparation Examples II-1 to II-6 respectively, pore-widened Substrate (A) for comparison and Substrate (i) having received anodic oxidation alone, a 0.25 weight % methanol solution of polyacrylic acid (weight average molecular weight: $2.5 \times 10^5$) as a subbing solution was coated at a coverage of 10 g/m$^2$ on a liquid basis, and dried for 60 seconds at 100° C. Thus, substrates provided with the subbing layer having a dry coverage of 25 mg/m$^2$ were prepared.

On each of the substrates thus prepared, the finely divided polystyrene-containing coating Composition 1 for the hydrophilic layer of Example I was coated at a coverage of 20 g/m$^2$ on a liquid basis, and dried for 60 seconds at 100° C. Thus, substrates provided with the hydrophilic layer having a dry coverage of 1.5 g/m$^2$ were prepared.

On the hydrophilic layer of each of the substrates thus prepared, an overcoat layer was formed at a dry coverage of 1.0 g/m$^2$ in the same manner as in Example I using the coating Composition OC-1 for an overcoat layer, thereby producing heat-sensitive lithographic printing plate precursors.

The thus produced lithographic printing plate precursors were each exposed and used for printing in accordance with the same methods as adopted in Example I. The results obtained are shown in Table 9.

TABLE 9

| | | Smudges generating in process of printing | | Number of |
|---|---|---|---|---|
| | Substrate | Scumming resistance | Ink eliminability | clearly printed matters |
| Example II-1 | (IIA1) | good | good | 15,000 |
| Example II-2 | (IIA2) | good | good | 16,000 |
| Example II-3 | (IIA3) | good | good | 15,000 |
| Example II-4 | (IIA4) | good | good | 15,000 |
| Example II-5 | (IIA5) | good | good | 16,000 |
| Example II-6 | (IIA6) | good | good | 14,000 |
| Comparative Example II-1 | (A) | Not so poor | poor | 20,000 |
| Comparative Example II-2 | (i) | Not so poor | poor | 2,000 |

As can be seen from the data shown above, the present heat-sensitive lithographic printing plate precursors ensured excellent impression capacity and satisfactorily high scumming resistance.

Examples II-7 to II-12

Comparative Examples II-3 to II-4

Heat-sensitive lithographic printing plate precursors were produced using the finely divided polymethyl methacrylate-containing coating Composition 2 prepared for a hydrophilic layer in Example I-3 in combination with Substrates (IIB1) to (IIB6) respectively. In addition, comparative lithographic printing plate precursors were produced in the same manner as the above, except that the substrates used were replaced by comparative Substrates (IIB) and (i) respectively.

Then, each of these printing plate precursors was exposed and used for printing in accordance with the same methods as adopted in Example I-1. The results obtained are shown in Table 10.

TABLE 10

| | Substrate | Smudges generating in process of printing: Scumming resistance | Smudges generating in process of printing: Ink eliminability | Number of clearly printed matters |
|---|---|---|---|---|
| Example II-7 | (IIB1) | Good | good | 20,000 |
| Example II-8 | (IIB2) | Good | good | 20,000 |
| Example II-9 | (IIB3) | Good | good | 18,000 |
| Example II-10 | (IIB4) | Good | good | 18,000 |
| Example II-11 | (IIB5) | good | good | 18,000 |
| Example II-12 | (IIB6) | good | good | 20,000 |
| Comparative Example II-3 | (IIB) | Not so poor | poor | 25,000 |
| Comparative Example II-4 | (i) | Not so poor | not so poor | 1,500 |

As can be seen from the data shown above, the present heat-sensitive lithographic printing plate precursors ensured excellent impression capacity and satisfactorily high scumming resistance.

Examples II-13 to II-24

Comparative Examples II-5 to II-8

Heat-sensitive lithographic printing plate precursors were produced by applying the coating Composition 3 or 4 prepared for a hydrophilic layer in Example I-7 or I-9 to Substrates (IIA1) to (IIA6) respectively in combinations as shown in Table 11. Additionally, these substrates were obtained in Preparation Examples II-1 to II-6 respectively. Each of the hydrophilic layers coated was dried for 60 seconds at 100° C. by the use of an oven. The dry coverage thereof was 0.5 g/m$^2$. In addition, comparative lithographic printing plate precursors were produced in the same manner as the above, except that the substrates used were replaced by comparative Substrates (A) and (i) respectively.

Then, each of the thus produced printing plate precursors having on-press developability was exposed and used for printing in accordance with the same methods as adopted in Example I-7. Therein, the on-press development of all the printing plate precursors was achieved without any troubles, and it was possible to perform the printing from each of the printing plates having received such processing. The printing results obtained are shown in Table 11.

TABLE 11

| | Substrate | Coating composition for hydrophilic layer | Smudges generating in process of printing: Scumming resistance | Smudges generating in process of printing: Ink eliminability | Number of clearly printed matters |
|---|---|---|---|---|---|
| Example II-3 | (IIA1) | 3 | good | good | 20,000 |
| Example II-14 | (IIA2) | 3 | good | good | 21,000 |
| Example II-15 | (IIA3) | 3 | good | good | 20,000 |
| Example II-16 | (IIA4) | 3 | good | good | 19,000 |
| Example II-17 | (IIA5) | 3 | good | good | 21,000 |
| Example II-18 | (IIA6) | 3 | good | good | 18,000 |
| Example II-19 | (IIA1) | 4 | good | good | 25,000 |
| Example II-20 | (IIA2) | 4 | good | good | 25,000 |
| Example II-21 | (IIA3) | 4 | good | good | 24,000 |
| Example II-22 | (IIA4) | 4 | good | good | 22,000 |
| Example II-23 | (IIA5) | 4 | good | good | 25,000 |
| Example II-24 | (IIA6) | 4 | good | good | 25,000 |
| Comparative Example II-5 | (A) | 3 | not so poor | poor | 25,000 |
| Comparative Example II-6 | (i) | 3 | not so poor | poor | 2,000 |
| Comparative Example II-7 | (A) | 4 | not so poor | poor | 30,000 |
| Comparative Example II-8 | (i) | 4 | not so poor | poor | 2,500 |

Examples II-25 to II-36

Comparative Examples II-9 to II-12

Heat-sensitive lithographic printing plate precursors were produced by applying the coating Composition 3 or 4 prepared for a hydrophilic layer in Example I-7 or I-9 to Substrates (IIB1) to (IIB6) respectively in combinations as shown in Table 12. Additionally, these substrates were obtained in Preparation Examples II-7 to II-12 respectively. Each of the hydrophilic layers coated was dried for 60 seconds at 100° C. by the use of an oven. The dry coverage thereof was 0.7 g/m$^2$. In addition, comparative lithographic printing plate precursors were produced in the same manner as the above, except that the substrates used were replaced by comparative Substrates (IIB) and (i) respectively.

Then, each of the thus produced printing plate precursors having on-press developability was exposed under the conditions adopted in Example I-9, and the printing therefrom was performed under the same conditions as in Example I-7. The printing results obtained are shown in Table 12. Therein, the on-press development of all the printing plate precursors was achieved without any troubles.

TABLE 12

| | Substrate | Coating Composition for hydrophilic layer | Smudges generating in process of printing: Scumming resistance | Smudges generating in process of printing: Ink eliminability | Number of clearly printed matters |
|---|---|---|---|---|---|
| Example II-25 | (IIB1) | 3 | good | good | 18,000 |
| Example II-26 | (IIB2) | 3 | good | good | 18,000 |
| Example II-27 | (IIB3) | 3 | good | good | 20,000 |
| Example II-28 | (IIB4) | 3 | good | good | 20,000 |
| Example II-29 | (IIB5) | 3 | good | good | 18,000 |
| Example II-30 | (IIB6) | 3 | good | good | 17,000 |
| Example II-31 | (IIB1) | 4 | good | good | 20,000 |
| Example II-32 | (IIB2) | 4 | good | good | 19,000 |
| Example II-33 | (IIB3) | 4 | good | good | 20,000 |
| Example II-34 | (IIB4) | 4 | good | good | 20,000 |
| Example II-35 | (IIB5) | 4 | good | good | 18,000 |
| Example II-36 | (IIB6) | 4 | good | good | 18,000 |
| Comparative Example II-9 | (IIB) | 3 | not so poor | poor | 22,000 |
| Comparative Example II-10 | (i) | 3 | not so poor | poor | 2,000 |
| Comparative Example II-11 | (IIB) | 4 | not so poor | poor | 25,000 |
| Comparative Example II-12 | (i) | 4 | not so poor | poor | 2,500 |

Examples III-1 to III-5

Comparative Examples III-1 to III-2

On each of the subbing layer provided Substrates (IIIA1) to (IIIA5) prepared in Preparation Examples III-1 to III-5 respectively and the comparative Substrates (A) and (i), the coating Composition 1 prepared for a hydrophilic layer in Example I-1 was coated, and dried for 60 seconds at 100° C. by means of an oven, thereby forming a hydrophilic layer having a dry coverage of 1.0 g/m$^2$.

On the hydrophilic layer of each of the substrates thus prepared, an overcoat layer was formed at a dry coverage of 1.0 g/m$^2$ in the same manner as in Example I using the coating Composition OC-1 for an overcoat layer, thereby producing heat-sensitive lithographic printing plate precursors.

The thus produced lithographic printing plate precursors were each exposed and used for printing in accordance with the same methods as adopted in Example I-1. The results obtained are shown in Table 13.

TABLE 13

| | Substrate | Smudges generating in process of printing: Scumming resistance | Smudges generating in process of printing: Ink eliminability | Number of clearly printed matters |
|---|---|---|---|---|
| Example III-1 | (IIIA1) | good | good | 20,000 |
| Example III-2 | (IIIA2) | good | good | 18,000 |
| Example III-3 | (IIIA3) | good | good | 20,000 |
| Example III-4 | (IIIA4) | good | good | 18,000 |
| Example III-5 | (IIIA5) | good | good | 20,000 |
| Comparative Example III-1 | (A) | good | not so poor | 3,000 |
| Comparative Example III-2 | (i) | good | poor | 20,000 |

The results shown above reveal that all the heat-sensitive lithographic printing plate precursors according to the present invention caused no scumming, had satisfactorily high ink eliminability, and ensured excellent press life of the order of 20,000 sheets.

Examples III-6 to III-11

Comparative Examples III-3 to III-6

On the subbing layer-provided Substrates (IIIA1) to (IIIA5) prepared in Preparation Examples III-1 to III-5 respectively and the comparative Substrates (i) and (A), the coating Composition 3prepared for a hydrophilic layer in Example I-7 or the coating Composition 4 prepared for a hydrophilic layer in Example I-9 was coated in combinations shown in Table 15. And each of the coating Compositions coated was dried for 60 seconds at 100° C. by means of an oven, thereby forming a hydrophilic layer having a dry coverage of 1.0 g/m$^2$.

The thus produced on-press developable lithographic printing plate precursors were each exposed and used for printing accordance with the same methods as adopted in Example I-7. The results obtained are shown in Table 14.

TABLE 14

| | Substrate | Coating composition for hydrophilic layer | Smudges generating in process of printing: Scumming resistance | Smudges generating in process of printing: Ink eliminability | Number of clearly printed matter |
|---|---|---|---|---|---|
| Example III-6 | (IIIA1) | 3 | good | good | 20,000 |
| Example III-7 | (IIIA2) | 3 | good | good | 20,000 |
| Example III-8 | (IIIA3) | 3 | good | good | 22,000 |
| Example III-9 | (IIIA4) | 4 | good | good | 25,000 |
| Example III-10 | (IIIA5) | 4 | good | good | 25,000 |
| Example III-11 | (i) | 4 | good | good | 27,000 |

TABLE 14-continued

| | Substrate | Coating composition for hydrophilic layer | Smudges generating in process of printing: Scumming resistance | Smudges generating in process of printing: Ink eliminability | Number of clearly printed matter |
|---|---|---|---|---|---|
| Comparative Example III-3 | (i) | 3 | good | good | 2,000 |
| Comparative Example III-4 | (i) | 4 | good | good | 2,500 |
| Comparative Example III-5 | (A) | 3 | good | poor | 20,000 |
| Comparative Example III-6 | (A) | 4 | good | poor | 25,000 |

Examples III-6 to III-11

Comparative Examples III-3 to III-6

On the subbing layer-provided Substrates (IIIA4) and (IIIA5) prepared in Preparation Examples III-4 to III-5 respectively and the comparative Substrates (i) and (A), the coating Composition 3prepared for a hydrophilic layer in Example I-7 or the coating Composition 4 prepared for a hydrophilic layer in Example I-9 was coated in combinations shown in Table 15. And each of the coating Compositions coated was dried for 60 seconds at 100° C. by means of an oven, thereby forming a hydrophilic layer having a dry coverage of 1.0 g/m$^2$.

The thus produced on-press developable lithographic printing plate precursors were each exposed and used for printing in accordance with the same methods as adopted in Example I-9. The results obtained are shown in Table 15.

TABLE 15

| | Substrate | Coating composition for hydrophilic layer | Smudges generating in process of printing: Scumming resistance | Smudges generating in process of printing: Ink eliminability | Number of clearly printed matter |
|---|---|---|---|---|---|
| Example III-12 | (IIIA4) | 3 | good | good | 20,000 |
| Example III-13 | (IIIA5) | 3 | good | good | 20,000 |
| Example III-14 | (IIIA4) | 4 | good | good | 23,000 |
| Example III-15 | (IIIA5) | 4 | good | good | 23,000 |
| Comparative Example III-7 | (A) | 3 | good | poor | 20,000 |
| Comparative Example III-8 | (A) | 4 | good | poor | 25,000 |

EFFECT OF THE INVENTION

Heat-sensitive lithographic printing plate precursors produced in accordance with the present invention can be mounted in a printing machine directly after exposure without development-processing, and subjected to printing operations. They have excellent on-press developability, and can ensure high impression capacity, scumming resistance and ink eliminability in the printing plates made therefrom.

While the present invention has been described in detail and with reference to specific embodiments thereof, it will be apparent to one skilled in the art that various changes and modifications can be made therein without departing from the spirit and scope thereof.

What is claimed is:

1. A heat-sensitive lithographic printing plate precursor which comprises a substrate having thereon an anodic oxidation layer, said printing plate precursor comprising a hydrophilic layer containing at least one kind of fine particles selected from the group consisting of heat-fusible hydrophobic thermoplastic fine particles, finely divided polymers having thermally reactive functional groups and microcapsules in which compounds having heat-reactive functional groups are encapsulated, and said anodic oxidation layer having a surface over which micropores having an average pore size of 6 to 40 nm and obtained by a pore-widening treatment and a pore-sealing treatment are uniformly distributed.

2. The heat-sensitive lithographic printing plate precursor as in claim 1, wherein the average pore size of micropores is controlled to 6 to 40 nm by subjecting the substrate having an anodic oxidation layer to a pore-widening treatment by immersion in sulfuric acid, phosphoric acid, a mixture of these acids or an aqueous alkali solution adjusted to pH 11–13, or to the pore-widening treatment and then to a pore-sealing treatment, wherein the micropores of the anodic oxidation layer on the substrate are narrowed at the surface portion of the anodic oxidation layer.

3. The heat-sensitive lithographic printing plate precursor as in claim 1, wherein the average pore size of micropores is controlled to 6 to 40 nm by subjecting the substrate having an anodic oxidation layer to a pore-widening treatment by immersion in an aqueous sulfuric acid solution and then to a pore-sealing treatment, wherein the micropores of the anodic oxidation layer on the substrate are narrowed at the surface portion of the anodic oxidation layer.

4. The heat-sensitive lithographic printing plate precursor as in claim 2 or 3, wherein the pore-sealing treatment is a treatment by steam.

5. A heat-sensitive lithographic printing plate precursor which comprises a substrate having thereon an anodic oxidation layer, said printing plate precursor comprising a hydrophilic layer containing at least one kind of fine particles selected from the group consisting of heat-fusible hydrophobic thermoplastic fine particles, finely divided polymers having heat-reactive functional groups and microcapsules in which compounds having heat-reactive functional groups are encapsulated, and said anodic oxidation layer having a surface over which micropores are subjected to a pore-widening treatment and then to an immersion treatment in an aqueous solution containing a hydrophilic compound wherein the micropores of the anodic oxidation layer are narrowed and/or sealed at the surface portion of the anodic oxidation layer.

6. The heat-sensitive lithographic printing plate precursor as in claim 5, wherein the hydrophilic compound is at least one compound selected from the group consisting of alkali metal silicates, zirconium potassium fluoride, mixtures of alkali metal phosphates and alkali metal fluorides, polyvinylphosphonic acid, sodium lignin sulfonate and saponin.

7. A heat-sensitive lithographic printing plate precursor which comprises a substrate having thereon an anodic oxidation layer, said printing plate precursor comprising a hydrophilic layer containing at least one kind of fine particles selected from the group consisting of heat-fusible hydrophobic thermoplastic fine particles, finely divided polymers having heat-reactive functional groups and microcapsules in which compounds having heat-reactive functional groups are encapsulated, and said anodic oxidation layer having a surface over which micropores are subjected to a pore-widening treatment wherein the micropores of the anodic oxidation layer are narrowed and/or sealed at the surface portion of the anodic oxidation layer are uniformly distributed and further having on the surface a subbing layer comprising a water-soluble resin containing carboxyl or carboxylato groups and a water-soluble salt containing at least one metal selected from the group consisting of zinc, calcium, magnesium, barium, strontium, cobalt, manganese and nickel.

8. The heat-sensitive lithographic printing plate precursor as in claim 7, wherein the water-soluble resin containing carboxyl or carboxylato groups is at least one resin selected from the group consisting of carboxymethyl cellulose, polyacrylic acid and acrylamide-methacrylic acid copolymer.

9. The heat-sensitive lithographic printing plate precursor as in claim 7, wherein the water-soluble salt of metal is an acetate of at least one metal selected from the group consisting of magnesium, nickel, manganese, calcium and nickel.

10. The heat-sensitive lithographic printing plate precursor as in claim 5 or 7, wherein the pore-widening treatment is a treatment carried out by immersing the substrate having an anodic oxidation layer in an aqueous solution of sulfuric acid or an aqueous alkali solution adjusted to pH 11–13.

11. The heat-sensitive lithographic printing plate precursor as in any of claims 1, 5 and 7, wherein the hydrophilic layer has thereon a water-soluble overcoat layer.

12. The heat-sensitive lithographic printing plate precursor as in any of claims 1, 5 and 7, wherein the hydrophilic layer has a water-soluble overcoat layer containing a light-to-heat converting agent.

13. A method of making a printing plate from a heat-sensitive lithographic printing plate precursor and printing from the printing plate made, comprising steps of imagewise exposing a heat-sensitive lithographic printing plate precursor as described in any of claims 1, 5 and 7, using laser beams, mounting the printing plate precursor imagewise exposed in a printing machine without any further processing, and then performing printing operations; or comprising steps of mounting in a printing machine a heat-sensitive lithographic printing plate precursor as described in any of claims 1, 5 and 7, imagewise exposing the printing plate precursor mounted in the printing machine, using laser beams and then performing printing operations without any further processing.

* * * * *